US011788417B2

(12) United States Patent
Wakazono et al.

(10) Patent No.: US 11,788,417 B2
(45) Date of Patent: Oct. 17, 2023

(54) TURBINE BLADE AND GAS TURBINE

(71) Applicant: Mitsubishi Power Ltd., Kanagawa (JP)

(72) Inventors: Susumu Wakazono, Kanagawa (JP); Yasuo Miyahisa, Tokyo (JP); Satoshi Hada, Kanagawa (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 150 days.

(21) Appl. No.: 17/439,636

(22) PCT Filed: Mar. 2, 2020

(86) PCT No.: PCT/JP2020/008670
§ 371 (c)(1),
(2) Date: Sep. 15, 2021

(87) PCT Pub. No.: WO2020/189237
PCT Pub. Date: Sep. 24, 2020

(65) Prior Publication Data

US 2022/0154581 A1 May 19, 2022

(30) Foreign Application Priority Data

Mar. 20, 2019 (JP) ..... 2019-053739

(51) Int. Cl.
*F01D 5/18* (2006.01)

(52) U.S. Cl.
CPC ..... *F01D 5/187* (2013.01); *F05D 2220/32* (2013.01); *F05D 2240/81* (2013.01); *F05D 2260/202* (2013.01)

(58) Field of Classification Search
CPC ..... F01D 5/145; F01D 5/183; F01D 5/187; F05D 2220/32; F05D 2240/81; F05D 2260/20; F05D 2260/202
See application file for complete search history.

(56) References Cited

U.S. PATENT DOCUMENTS 3,385,064 A * 5/1968 Wilde ..... F02C 3/064 416/198 A
4,465,433 A 8/1984 Bischoff
(Continued)

FOREIGN PATENT DOCUMENTS

CN 107923250 4/2018
DE 10 2014 115 475 4/2015
(Continued)

OTHER PUBLICATIONS

China Office Action dated Jan. 4, 2023 in corresponding Chinese Patent Application No. 202080020517.0, with partial English machine translation.

(Continued)

*Primary Examiner* — Loren C Edwards
(74) *Attorney, Agent, or Firm* — Wenderoth, Lind & Ponack, L.L.P.

(57) ABSTRACT

A turbine blade and a gas turbine are provided with: an airfoil portion (41) internally including a cooling air passage (60); a platform (42) provided in a blade base end portion (55) in a blade height direction (Dh) of the airfoil portion (41); and a fillet portion (80) provided around the entire perimeter of a connecting portion of the airfoil portion (41) and the platform (42). The fillet portion (80) includes a first fillet portion (81) which is provided on a rear side blade surface (53) side of the airfoil portion (41), on the trailing edge (52) side of a position at which the distance between the rear side blade surface (53) of the airfoil portion (41) and a rear side edge portion (44) of the platform (42) is shortest, and which has a fillet width (W) that is greater than the fillet width W of other regions of the fillet portion (80).

24 Claims, 9 Drawing Sheets

(56) References Cited

U.S. PATENT DOCUMENTS

| | | | | |
|---|---|---|---|---|
| 6,190,128 | B1 | 2/2001 | Fukuno et al. | |
| 6,390,775 | B1 | 5/2002 | Paz | |
| 6,481,967 | B2 * | 11/2002 | Tomita | F01D 5/186 415/115 |
| 10,352,180 | B2 | 7/2019 | Stein et al. | |
| 10,376,950 | B2 | 8/2019 | Takamura et al. | |
| 2001/0016163 | A1 | 8/2001 | Tomita et al. | |
| 2004/0081548 | A1 | 4/2004 | Zess et al. | |
| 2006/0275112 | A1 | 12/2006 | Lee et al. | |
| 2008/0166240 | A1 | 7/2008 | Scott et al. | |
| 2013/0101409 | A1 | 4/2013 | Beeck | |
| 2014/0130354 | A1 | 5/2014 | Pal et al. | |
| 2015/0110616 | A1 | 4/2015 | Stein et al. | |
| 2016/0273362 | A1 | 9/2016 | Li et al. | |
| 2018/0200783 | A1 | 7/2018 | Takamura et al. | |

FOREIGN PATENT DOCUMENTS

| | | | | |
|---|---|---|---|---|
| EP | 1 731 712 | | 12/2006 | |
| EP | 3018290 | A1 * | 5/2016 | F01D 5/147 |
| JP | 58-133403 | | 8/1983 | |
| JP | H0544691 | A * | 2/1991 | F04D 29/18 |
| JP | 5-44691 | | 2/1993 | |
| JP | 11-2101 | | 1/1999 | |
| JP | 2001-271603 | | 10/2001 | |
| JP | 2001271603 | A * | 10/2001 | F01D 5/186 |
| JP | 2002-213205 | | 7/2002 | |
| JP | 2004-137958 | | 5/2004 | |
| JP | 2010-196625 | | 9/2010 | |
| JP | 2010-203259 | | 9/2010 | |

OTHER PUBLICATIONS

Da-lei Wang et. al., "Influence of the root fillet on the flow pattern of an axial turbine rotor", Journal of Aerospace Power, vol. 26, No. 9, Sep. 2011, pp. 2075 2081, with English abstract.

International Search Report dated May 12, 2020 in corresponding International (PCT) Application No. PCT/JP2020/008670.

Written Opinion dated May 12, 2020 in corresponding International (PCT) Application No. PCT/JP2020/008670.

* cited by examiner

TURBINE BLADE AND GAS TURBINE

TECHNICAL FIELD

The present invention relates to a turbine blade such as a rotor blade and a stator vane applied to a gas turbine, and a gas turbine provided with the turbine blade.

BACKGROUND ART

A gas turbine includes a compressor, a combustor, and a turbine. The compressor compresses air taken in through an air intake port to obtain high-temperature and high-pressure compressed air. The combustor obtains a high-temperature and high-pressure combustion gas by supplying fuel to the compressed air and performing combustion. The turbine is driven by the combustion gas and drives a coaxially connected generator.

A technique is known in which a cooling passage is provided in a turbine blade such as a rotor blade and a stator vane in a gas turbine and a cooling fluid is caused to flow through the cooling passage such that the turbine blade exposed to a high-temperature gas stream is cooled. For example, in PTL 1 below, a technique is described in which a cooling air passage is provided in a rotor blade and cooling air is blown out through a hole on a trailing edge side after passing through the cooling air passage. In addition, a technique is also described in which a fillet portion having an oval shape is provided at a connecting portion between a blade base end portion and a platform in the rotor blade to reduce a thermal stress.

CITATION LIST

Patent Literature

[PTL 1] Japanese Unexamined Patent Application Publication No. H11-002101

SUMMARY OF INVENTION

Technical Problem

In the related art, as described above, a thermal stress is likely to be generated at a connecting portion between a blade base end portion and a platform in a turbine blade such as a rotor blade. Therefore, for the purpose of alleviating the thermal stress at the connecting portion between the blade base end portion and the platform, a fillet portion is formed at the connecting portion. With the fillet portion formed at the connecting portion, the thermal stress can be reduced. On the other hand, since a turbine blade receives a high-temperature gas stream, there is a demand for aerodynamically reducing the size of the fillet portion at the connecting portion between the blade base end portion and the platform.

The present invention has been made to solve the above-described problem, and an object thereof is to provide a turbine blade and a gas turbine that reduce a thermal stress at a fillet portion while suppressing a decrease in aerodynamic performance.

Solution to Problem

In order to achieve the object described above, an aspect of the present invention provides a turbine blade including an airfoil portion that internally includes a cooling air passage, a blade base end portion that is provided at an end portion of the airfoil portion in a blade height direction, and a fillet portion that is provided around an entire periphery of a connecting portion between the airfoil portion and the blade base end portion. The fillet portion includes a first fillet portion that is provided closer to a trailing edge than a position at which a distance between a suction side blade surface of the airfoil portion and a suction side end portion of the blade base end portion is smallest while being on a suction side of the airfoil portion and of which a fillet width is larger than a fillet width of other regions of the fillet portion.

Therefore, a portion of the fillet portion that is on the trailing edge side while being on the suction side of the airfoil portion is likely to receive a thermal stress. Since the first fillet portion, of which the fillet width is larger than the fillet width at the other regions of the fillet portion, is provided in this portion, a thermal stress in the fillet portion can be reduced.

In the turbine blade according to the aspect of the present invention, the first fillet portion is provided closer to the trailing edge than a throat portion between the airfoil portions adjacent to each other.

Therefore, there is less influence on a decrease in aerodynamic performance while a thermal stress at the fillet portion can be reduced.

In the turbine blade according to the aspect of the present invention, an aspect ratio, which is a ratio of a fillet height to the fillet width, of the first fillet portion is smaller than an aspect ratio of the other regions of the fillet portion.

Therefore, the fillet width of the first fillet portion is larger than the fillet width of the other fillet portions, and thus it is possible to reduce generation of a thermal stress caused due to thermal elongation at the fillet portion.

In the turbine blade according to the aspect of the present invention, the first fillet portion includes a region at which the aspect ratio is constant along a circumferential direction of the fillet portion.

Therefore, it is possible to reduce a thermal stress in a predetermined region along the circumferential direction of the fillet portion.

In the turbine blade according to the aspect of the present invention, the aspect ratio of the first fillet portion is 1.0.

Therefore, a thermal stress at the first fillet portion can be reduced.

In the turbine blade according to the aspect of the present invention, the first fillet portion includes a first end portion that is provided on a leading edge side of the airfoil portion along a blade surface of the fillet portion and a second end portion that is provided on the trailing edge side of the airfoil portion along the blade surface of the fillet portion, and the first end portion and the second end portion are connected to fillet change portions, at which a fillet width or a fillet height changes along the blade surface of the fillet portion.

Therefore, since the first fillet portion and the other fillet portions are connected to each other via the fillet change portions at which the fillet width or the fillet height changes, the fillet portion that is smoothly connected to a connecting portion between the airfoil portion and the blade base end portion is provided, and thus it is possible to suppress a decrease in aerodynamic performance and to suppress a sudden change in thermal stress.

In the turbine blade according to the aspect of the present invention, the airfoil portion includes a plurality of cooling holes that are arranged in a trailing edge portion at predetermined intervals in the blade height direction and each of which has one end communicating with the cooling air passage and has the other end open at a trailing edge end surface of the trailing edge portion and the fillet portion includes a second fillet portion that is provided on the trailing edge end surface while being close to the cooling holes and adjacent to an inner side in the blade height direction and of which a fillet height is smaller than a fillet height of other regions of the fillet portion.

Therefore, since the fillet height of the second fillet portion is smaller than the fillet height of the other fillet portions, the positions of the cooling holes in the blade height direction are closer to an upper surface of a platform than the other regions. Accordingly, the upper surface of the platform can be efficiently cooled by means of cooling air flowing through the cooling holes, and a thermal stress on the trailing edge portion side of the platform can be reduced.

In the turbine blade according to the aspect of the present invention, the fillet portion includes a third fillet portion that is connected to the first fillet portion via the fillet change portion along the suction side blade surface and is connected to the second fillet portion via the fillet change portion along a pressure side blade surface with a leading edge of the airfoil portion interposed therebetween.

Therefore, since the third fillet portion is provided over an area from the suction side blade surface to the pressure side blade surface with the leading edge of the airfoil portion interposed therebetween in addition to a first fillet and the second fillet portion, a fillet having an appropriate shape can be provided around the entire periphery between the airfoil portion and the blade base end portion. In addition, since the fillet change portions are provided, a decrease in aerodynamic performance can be suppressed.

In the turbine blade according to the aspect of the present invention, the third fillet portion includes a region at which an aspect ratio of a fillet height to a fillet width is constant along the blade surface of the fillet portion.

Therefore, it is possible to reduce a thermal stress in a predetermined region along the circumferential direction of the fillet portion.

In the turbine blade according to the aspect of the present invention, the fillet change portions include a first fillet change portion provided between the first end portion and a third end portion, and a fillet width of the first fillet change portion becomes smaller toward the third end portion from the first end portion while a fillet height of the first fillet change portion is maintained constant.

Therefore, the first fillet portion and the third fillet portion can be smoothly connected to each other by means of the first fillet change portion, and it is possible to suppress a decrease in aerodynamic performance and to suppress a sudden change in thermal stress.

In the turbine blade according to the aspect of the present invention, the first fillet change portion includes a fillet having an oval shape, of which an aspect ratio of a fillet height to a fillet width exceeds 1.0.

Therefore, the first fillet portion and the third fillet portion can be smoothly connected by means of the first fillet change portion.

In the turbine blade according to the aspect of the present invention, the fillet change portions include a second fillet change portion provided between the second end portion and the second fillet portion, and a fillet width and a fillet height of the second fillet change portion become smaller toward the second fillet portion from the second end portion.

Therefore, the first fillet portion and the second fillet portion can be smoothly connected to each other by means of the second fillet change portion, and it is possible to suppress a decrease in aerodynamic performance and to suppress a sudden change in thermal stress.

In the turbine blade according to the aspect of the present invention, the second fillet change portion includes a fillet having an oval shape, of which an aspect ratio of a fillet height to a fillet width exceeds 1.0.

Therefore, the first fillet portion and the second fillet portion can be smoothly connected by means of the second fillet change portion.

In the turbine blade according to the aspect of the present invention, the fillet change portions include a third fillet change portion provided between the fourth end portion and the second fillet portion, and a fillet height of the third fillet change portion becomes smaller toward the second fillet portion from the fourth end portion while a fillet width of the third fillet change portion is maintained constant.

Therefore, the second fillet portion and the third fillet portion can be smoothly connected to each other by means of the third fillet change portion, and it is possible to suppress a decrease in performance.

In the turbine blade according to the aspect of the present invention, the third fillet change portion includes a fillet having an oval shape, of which an aspect ratio of a fillet height to a fillet width exceeds 1.0.

Therefore, the second fillet portion and the third fillet portion can be smoothly connected by means of the third fillet change portion.

In the turbine blade according to the aspect of the present invention, the plurality of cooling holes include end portion cooling holes, of which an opening density is higher than an opening density of a plurality of other cooling holes, at positions adjacent to the second fillet portion on the blade base end portion side of the airfoil portion, and the end portion cooling holes are disposed to be adjacent to the airfoil portion side of the second fillet portion in the blade height direction.

Therefore, the cooling ability with respect to the vicinity of the second fillet portion is enhanced since the cooling holes of which the opening density is high are disposed close to the second fillet portion, and the cooling performance with respect to the second fillet portion can be improved.

In the turbine blade according to the aspect of the present invention, the first fillet portion is provided along a blade wall of a final passage on a most downstream side in a cooling air flow direction in the cooling air passage.

Therefore, the first fillet portion can be effectively cooled by means of cooling air flowing through the final passage in the cooling air passage.

In the turbine blade according to the aspect of the present invention, the cooling air passage includes a meandering passage provided in the airfoil portion, the first fillet portion is provided along the final passage on the most downstream side in the cooling air flow direction in the meandering passage, and a length of a region of the first fillet portion falls within a range of a length of the final passage in a chord direction.

Therefore, since the length of the final passage in the chord direction is larger than the length of the region of the first fillet portion, the first fillet portion can be appropriately cooled by means of cooling air flowing through the final passage.

In the turbine blade according to the aspect of the present invention, the blade base end portion includes a platform that extends in a direction orthogonal to the blade height direction of the airfoil portion, the platform includes a recessed groove portion that is formed at a trailing edge portion end surface of the platform and is recessed toward a leading edge side from the trailing edge portion end surface, the recessed groove portion extends from a pressure side end portion to a suction side end portion of the platform, and a leading edge side end portion of the recessed groove portion is provided to become closer to the trailing edge portion end surface of the platform toward the suction side end portion from the pressure side end portion of the platform.

Therefore, since the leading edge side end portion of the recessed groove portion is provided to become closer to the trailing edge portion of the platform toward the suction side from a pressure side of the airfoil portion, the rigidity of the platform 42 is decreased at a portion where the recessed groove portion is provided, and thus a stress at the blade trailing edge portion of the airfoil portion can be reduced.

In the turbine blade according to the aspect of the present invention, the end portion of the recessed groove portion that is on the leading edge side of the platform is positioned between a final passage on a most downstream side in a cooling air flow direction in the cooling air passage and the trailing edge end surface of the airfoil portion as seen in a plan view of the platform.

Therefore, with the recessed groove portion being close to the final passage in the cooling air passage, the recessed groove portion can be formed to have a sufficient depth in the vicinity of the connecting portion between the blade trailing edge portion of the airfoil portion and the platform.

In the turbine blade according to the aspect of the present invention, the end portion of the recessed groove portion that is on the leading edge side of the platform is linearly formed toward the suction side end portion from the pressure side end portion of the platform.

Therefore, since the end portion of the recessed groove portion is linear, the workability can be improved.

In the turbine blade according to the aspect of the present invention, the platform includes a first cooling passage that extends from the leading edge to the trailing edge along the suction side end portion of the airfoil portion platform and a second cooling passage that extends from the leading edge to the trailing edge along the pressure side end portion of the platform, and the first cooling passage and the second cooling passage communicate with the cooling air passage of the airfoil portion on an upstream side in a cooling air flow direction and are open to a combustion gas at the trailing edge portion end surface on a downstream side in the cooling air flow direction.

Therefore, since the cooling passages are provided in the platform and the cooling passages communicate with the cooling air passage, it is possible to efficiently cool the platform by supplying cooling air cooling the airfoil portion to the platform.

In the turbine blade according to the aspect of the present invention, the turbine blade is a rotor blade.

Therefore, it is possible to suppress a decrease in performance of the rotor blade and to reduce a thermal stress at the fillet portion.

In addition, a gas turbine according to the present invention includes a compressor that compresses air, a combustor that mixes compressed air compressed by the compressor and fuel with each other and that performs combustion, and a turbine that includes the turbine blade and that obtains rotational power by means of a combustion gas generated by the combustor.

Therefore, it is possible to suppress a decrease in performance of the turbine and to reduce a thermal stress at the fillet portion.

Advantageous Effects of Invention

According to the turbine blade and the gas turbine of the present invention, it is possible to suppress a decrease in aerodynamic performance and to reduce a thermal stress at a fillet portion.

DESCRIPTION OF EMBODIMENTS

Hereinafter, preferred embodiments of the present invention will be described in detail with reference to the drawings. Note that the present invention is not limited by the embodiments, and in a case where there are a plurality of embodiments, the present invention encompasses combinations of the embodiments.

First Embodiment

Figure 1:
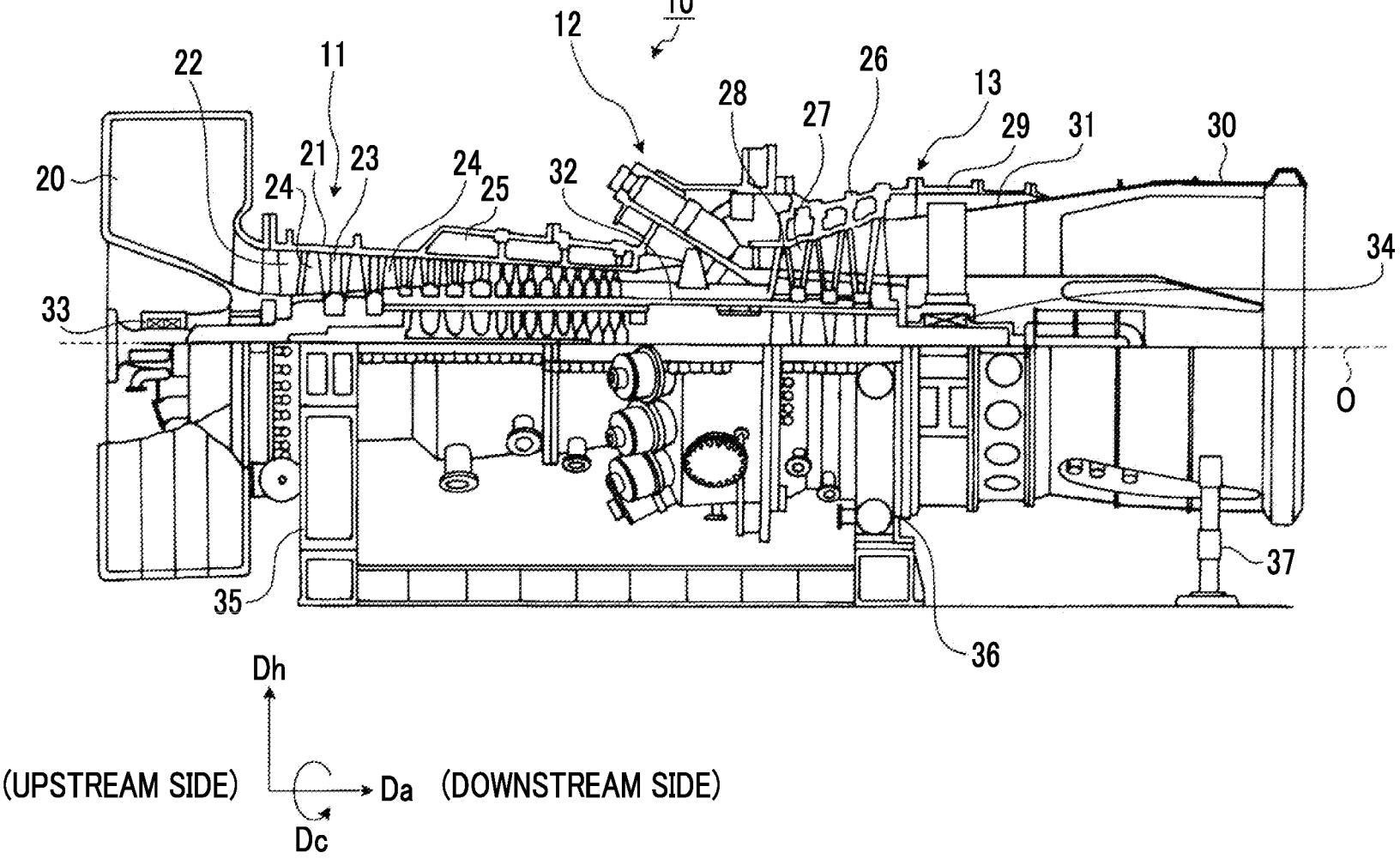
FIG. 1 is a schematic view showing the entire configuration of a gas turbine according to a first embodiment.

FIG. 1 is a schematic view showing the entire configuration of a gas turbine according to a first embodiment. Note that in the following description, when a central axis of a rotor of the gas turbine is O, a direction in which the central axis O extends will be referred to as an axial direction Da, a radial direction of the rotor that is orthogonal to the central axis O of the rotor will be referred to as a blade height direction Dh, and a circumferential direction around the central axis O of the rotor will be referred to as a circumferential direction Dc.

In the first embodiment, a gas turbine 10 includes a compressor 11, a combustor 12, and a turbine 13 as shown in FIG. 1. A generator (not shown) is coaxially connected to the gas turbine 10, and the generator can generate power.

The compressor 11 includes an air intake port 20 through which air is taken in, an inlet guide vane (IGV) 22 is provided in a compressor casing 21, a plurality of stator vanes 23 and a plurality of rotor blades 24 are alternately provided in the axial direction Da, and an air bleeding chamber 25 is provided on the outside thereof. The combustor 12 can perform combustion by supplying fuel with respect to compressed air compressed by the compressor 11 and burning the mixture thereof. In the turbine 13, a plurality of stator vanes 27 and a plurality of rotor blades 28 are alternately provided in the axial direction Da in a turbine casing 26. An exhaust chamber 30 is provided downstream of the turbine casing 26 with an exhaust casing 29 interposed therebetween, and the exhaust chamber 30 includes an exhaust diffuser 31 that is aligned with the turbine 13.

In addition, a rotor 32 is positioned such that the rotor 32 penetrates the central portions of the compressor 11, the combustor 12, the turbine 13, and the exhaust chamber 30. An end portion of the rotor 32 that is on the compressor 11 side is rotatably supported by a bearing portion 33, and an end portion that is on the exhaust chamber 30 side is rotatably supported by a bearing portion 34. A plurality of disks, onto which the rotor blades 24 are respectively mounted, are laid on and fixed to the rotor 32 at the compressor 11, a plurality of disks, onto which the rotor blades 28 are respectively mounted, are laid on and fixed to the rotor 32 at the turbine 13, and a drive shaft of the generator (not shown) is connected to the end portion on the compressor 11 side.

Regarding the gas turbine 10, the compressor casing 21 of the compressor 11 is supported by a leg portion 35, the turbine casing 26 of the turbine 13 is supported by a leg portion 36, and the exhaust chamber 30 is supported by a leg portion 37.

Therefore, air taken in through the air intake port 20 of the compressor 11 passes through the inlet guide vane 22, the plurality of stator vanes 23, and the plurality of rotor blades 24 and is compressed to become high-temperature and high-pressure compressed air. In the combustor 12, predetermined fuel is supplied with respect to the compressed air, and combustion is performed. A high-temperature and high-pressure combustion gas, which is a working fluid generated in the combustor 12, passes through the plurality of stator vanes 27 and the plurality of rotor blades 28 constituting the turbine 13 to drive and rotate the rotor 32 and to drive the generator connected to the rotor 32. Meanwhile, the combustion gas that drives the turbine 13 is discharged to the atmosphere as an exhaust gas.

Figure 2:
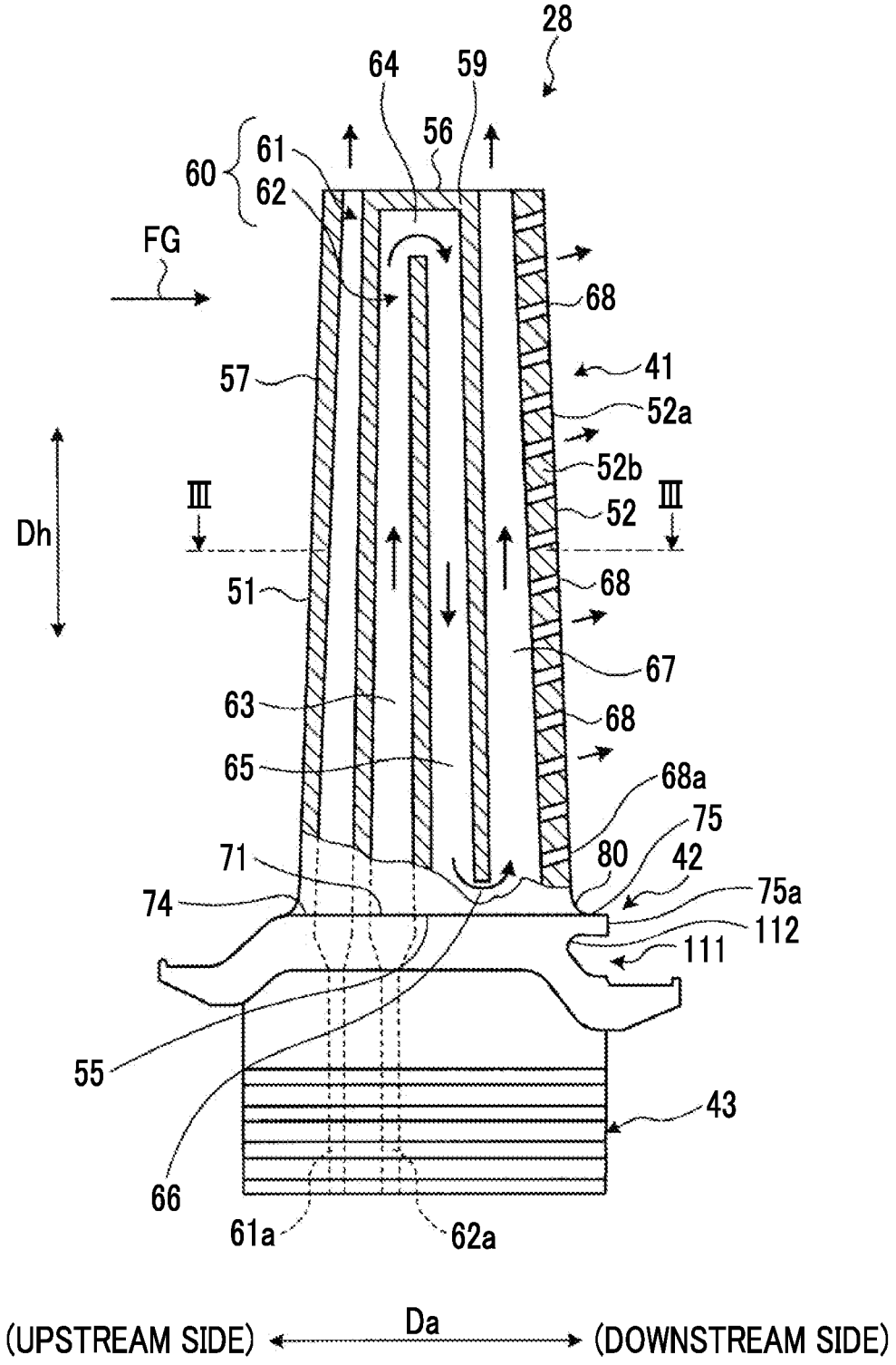
FIG. 2 is a rear view showing a cross-section of a rotor blade as a turbine blade in the first embodiment.
Figure 3:
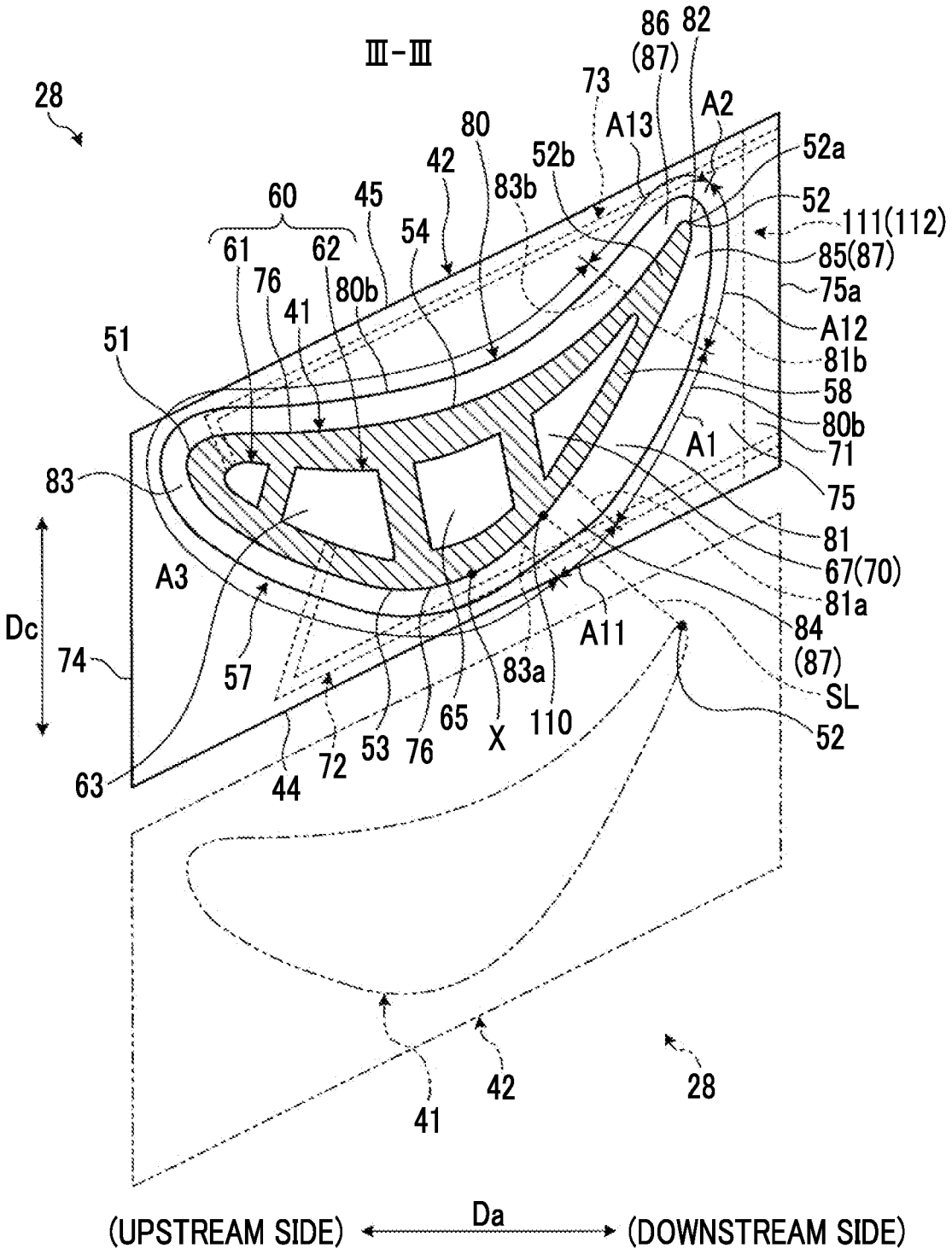
FIG. 3 is a cross-sectional view showing the rotor blade as a turbine blade as seen along arrow III-III in FIG. 2.
Figure 4:
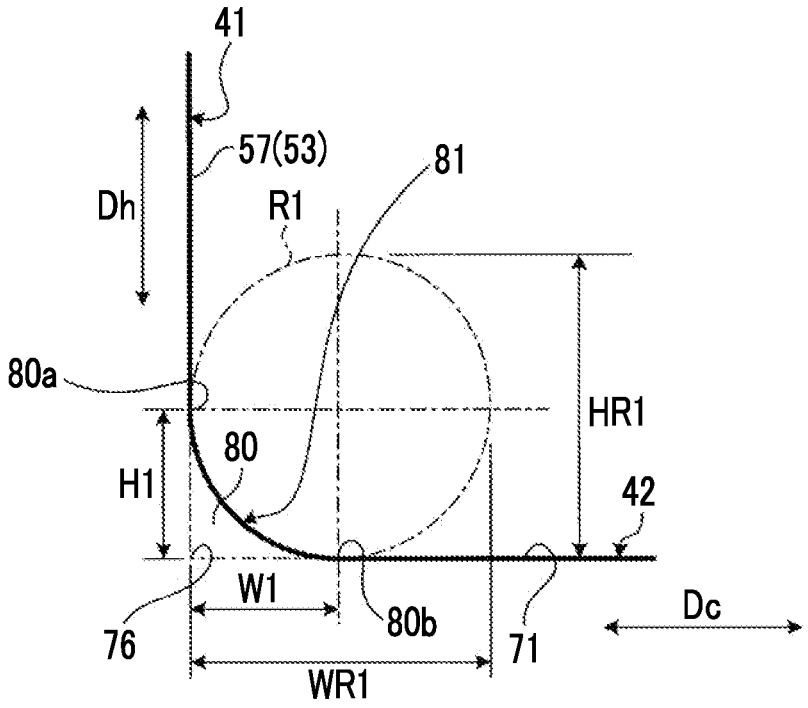
FIG. 4 is a cross-sectional view of a first fillet portion.
Figure 5:
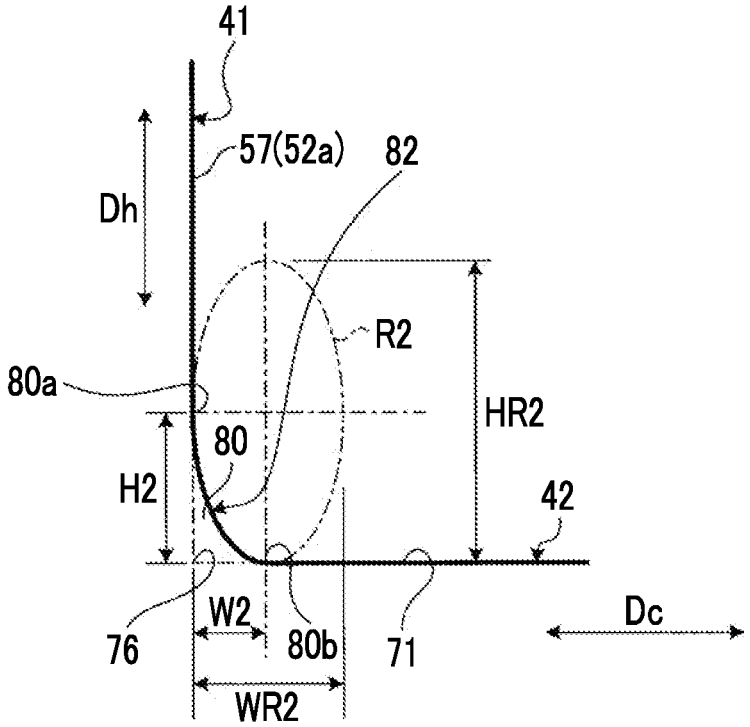
FIG. 5 is a cross-sectional view of a second fillet portion.
Figure 6:
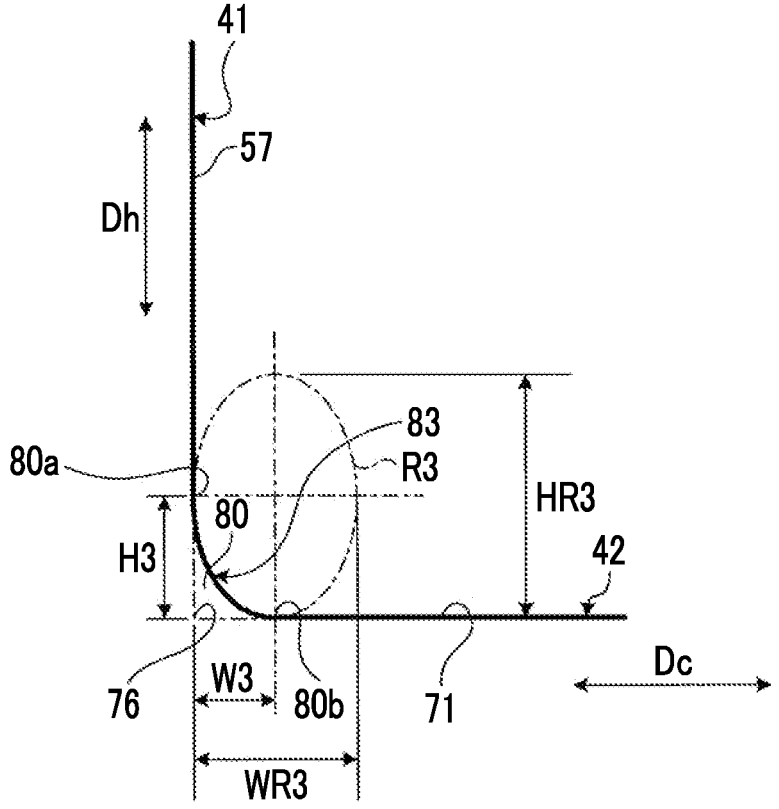
FIG. 6 is a cross-sectional view of a third fillet portion.

FIG. 2 is a rear view showing a cross-section of a rotor blade as a turbine blade in the first embodiment, FIG. 3 is a cross-sectional view showing the rotor blade as a turbine blade as seen along arrow III-III in FIG. 2, FIG. 4 is a cross-sectional view of a first fillet portion, FIG. 5 is a cross-sectional view of a second fillet portion, and FIG. 6 is a cross-sectional view of a third fillet portion.

As shown in FIGS. 2 and 3, the rotor blade 28, which is a turbine blade, includes an airfoil portion 41, a platform 42 as a blade base end portion, and a blade root portion 43. The airfoil portion 41 is disposed along the blade height direction Dh and is integrally formed with the platform 42 while being connected to an upper surface 71 of the platform 42 on a blade base end portion 55. The blade root portion 43 is fixed to the rotor 32 (refer to FIG. 1). Therefore, the rotor blade 28 rotates together with the rotor 32.

The airfoil portion 41 is integrally formed by means of a blade surface 57 and a top plate 59 formed on a blade tip portion 56 side in the blade height direction Dh, the blade surface 57 being composed of a suction side blade surface 53 on a suction surface side that extends in the blade height direction Dh and that has a protruding shape and a pressure side blade surface 54 on a pressure surface side that has a recessed shape. The airfoil portion 41 has a hollow shape, the suction side blade surface 53 and the pressure side blade surface 54 are connected to each other on an upstream side in a flow direction of a combustion gas FG along the axial direction Da such that a leading edge 51 is formed and are connected to each other on a downstream side such that a trailing edge 52 is formed, and a trailing edge end surface 52*a* is formed at a trailing edge downstream side end surface. The airfoil portion 41 has a tapered shape that becomes narrower toward the blade tip portion 56 from the blade base end portion 55 and is bonded to the top plate 59 on the blade tip portion 56 side in the blade height direction Dh.

In the airfoil portion 41, a cooling air passage 60 is provided. The cooling air passage 60 includes a first cooling air passage 61, a second cooling air passage 62, a first supply passage 61*a*, and a second supply passage 62*a*. The first cooling air passage 61 is provided along the blade height direction Dh on the leading edge 51 side of the airfoil portion 41, is connected to the first supply passage 61*a* on the blade base end portion 55 side, and is open at the top plate 59 on the blade tip portion 56 side. The first supply passage 61*a* and the second supply passage 62*a* are formed in the blade root portion 43 and take in cooling air from the outside. In the first cooling air passage 61, cooling air supplied from the first supply passage 61*a* flows along the leading edge 51 in one direction in the blade height direction Dh, and the cooling air is discharged into the combustion gas FG on the outside via an opening formed in the top plate 59 on the blade tip portion 56 side. The second cooling air passage 62 is connected to the second supply passage 62*a* on the blade base end portion 55 side, and cooling air is supplied thereto from the second supply passage 62*a*. The second cooling air passage 62 is formed as a meandering passage (serpentine passage) inside the airfoil portion 41 and is provided on the trailing edge 52 side while being adjacent to the first cooling air passage 61. The second cooling air passage 62 includes a first passage 63, a first turn-back passage 64, a second passage 65, a second turn-back passage 66, and a third passage 67. The first passage 63, the second passage 65, and the third passage 67 are provided along the blade height direction Dh, and the third passage 67 is connected to the opening formed in the top plate 59 on the blade tip portion 56 side. In the second cooling air passage 62, cooling air supplied from the second supply passage 62*a* flows through the first passage 63, the first turn-back passage 64, the second passage 65, the second turn-back passage 66, and the third passage 67 in this other, and the cooling air is discharged to the outside via an opening formed in the top plate 59 of the blade tip portion 56. An inner wall of the airfoil portion 41 is convection-cooled with cooling air flowing through the first cooling air passage 61 and the second cooling air passage 62.

In addition, regarding the airfoil portion 41, a plurality of cooling holes 68 are provided in a blade trailing edge portion 52*b* on the trailing edge 52 side. The plurality of cooling holes 68 are arranged at predetermined intervals in the blade height direction Dh. Each of the plurality of cooling holes 68 communicates with the third passage 67 at one end 102 (refer to FIG. 9), which is an upstream end in a cooling air flow direction, and is open at the trailing edge end surface 52*a* of the trailing edge 52 at the other end 103 (refer to FIG. 9), which is a downstream end in the cooling air flow direction. With cooling air flowing through the cooling holes 68 formed in the blade trailing edge portion 52*b*, the blade trailing edge portion 52*b* is convection-cooled.

The platform 42 is provided with a first cooling passage 72 that is on the suction side blade surface 53 side of the airfoil portion 41 and a second cooling passage 73 that is on the pressure side blade surface 54 side. In the axial direction Da, the first cooling passage 72 and the second cooling passage 73 extend from a leading edge portion 74 to a trailing edge portion 75 of the platform 42 along the upper surface 71 of the platform 42. An upstream end of the first cooling passage 72 in the cooling air flow direction communicates with the second cooling air passage 62 of the airfoil portion 41, and a downstream end thereof in the cooling air flow direction is open at a trailing edge portion end surface 75*a*. An upstream end of the second cooling passage 73 in the cooling air flow direction communicates with the first cooling air passage 61 of the airfoil portion 41, and a downstream end thereof in the cooling air flow direction is open at the trailing edge portion end surface 75*a*. The first cooling passage 72 and the second cooling passage 73 take in a portion of cooling air from the first cooling air passage 61 and the second cooling air passage 62 of the airfoil portion 41 so that a suction side end portion 44 and a pressure side end portion 45 of the platform 42 are convection-cooled. An upstream end to which the first cooling passage 72 is connected may be the first cooling air passage 61, and an upstream end to which the second cooling passage 73 is connected may be the second cooling air passage 62.

Figure 8:
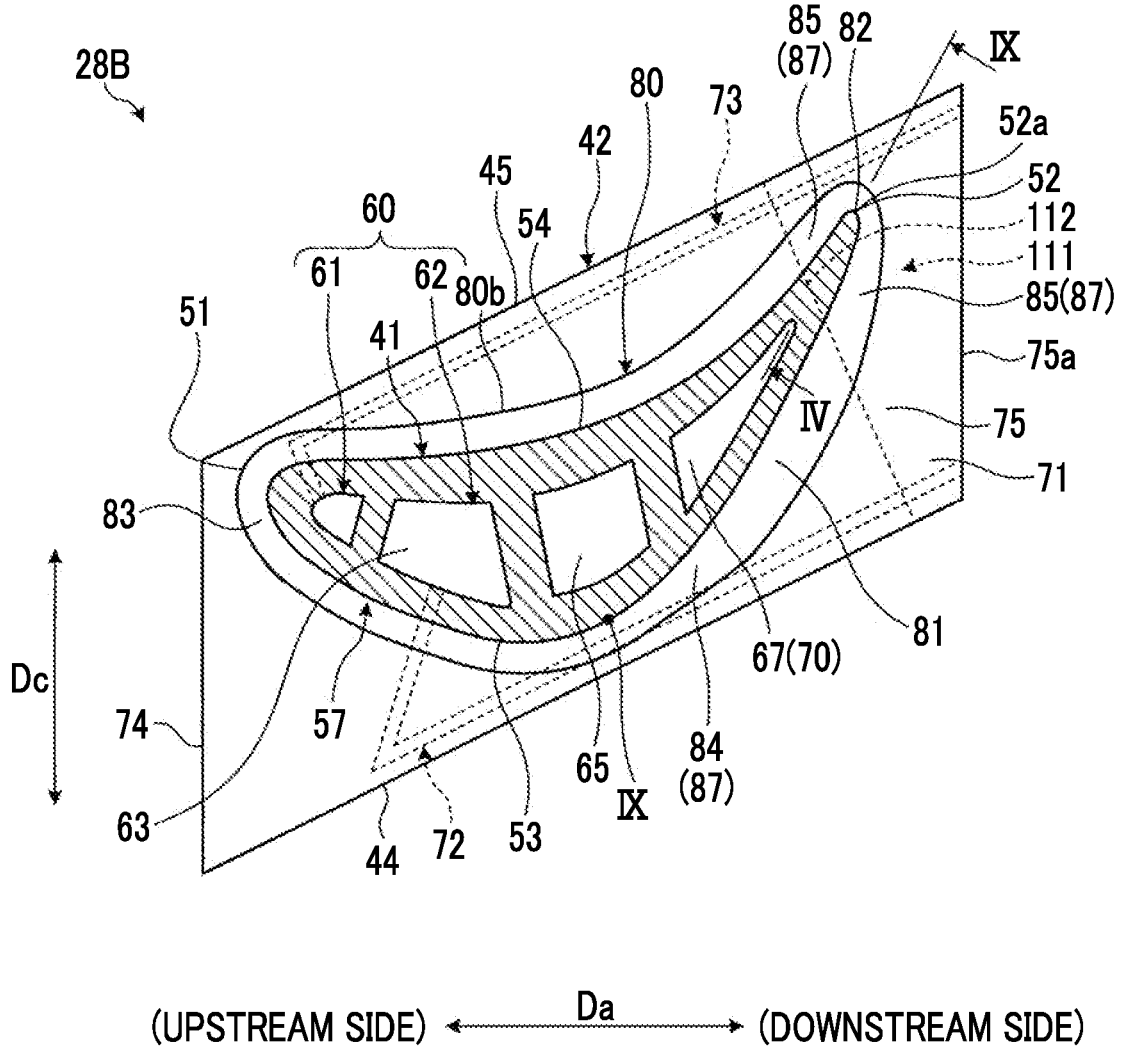
FIG. 8 is a cross-sectional view showing a rotor blade as a turbine blade in a second embodiment.
Figure 9:
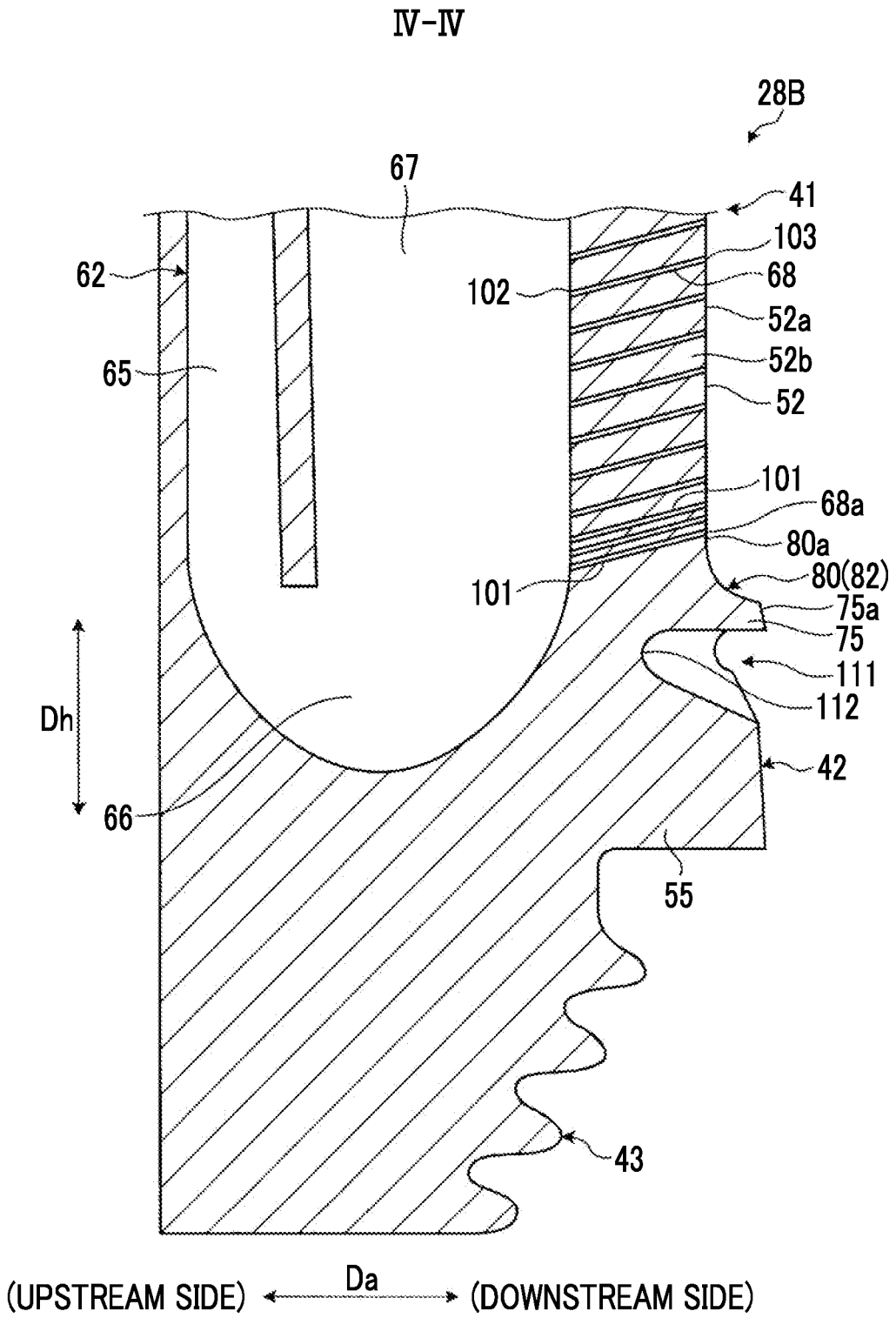
FIG. 9 is a cross-sectional view showing the vicinity of a blade base end portion of the turbine blade as seen along arrow IX-IX in FIG. 8.

As shown in FIGS. 3, 8, and 9, the trailing edge portion 75 of the platform 42 is provided with a recessed groove portion 111 for the purpose of suppressing a thermal stress generated at the platform 42. The recessed groove portion 111 is formed on the trailing edge portion end surface 75*a* of the trailing edge portion 75 of the platform 42 and is provided to be recessed toward the leading edge 51 side. That is, the recessed groove portion 111 is formed toward the trailing edge portion end surface 75*a* of the platform 42 with a leading edge side end portion 112 being an end portion on the most upstream side in the axial direction Da and is open at the trailing edge portion end surface 75*a*, the leading edge side end portion 112 forming a portion of the recessed groove portion 111. The leading edge side end portion 112 of the recessed groove portion 111 is provided from the suction side end portion 44 side of the platform 42 to the pressure side end portion 45 side along the circumferential direction Dc. Therefore, an opening of the recessed groove portion is formed from the suction side end portion 44 side to the pressure side end portion 45 at the trailing edge portion end surface 75*a* of the platform 42, is a portion of the suction side end portion 44 side and the pressure side end portion 45, and is formed over a range from the trailing edge portion end surface 75*a* to a connection position with respect to the leading edge side end portion 112 which is on the upstream side in the axial direction Da.

In addition, as shown in FIG. 3, regarding the rotor blade 28, a fillet portion 80 is provided around the entire periphery of the blade surface 57 of the airfoil portion 41 so that stress concentration on a connecting portion 76 between the airfoil portion 41 and the platform 42 is prevented. The fillet portion 80 includes a first fillet portion 81, a second fillet portion 82, and a third fillet portion 83. The shapes of the first fillet portion 81, the second fillet portion 82, and the third fillet portion 83 shown in FIGS. 4 to 6 are the cross-sectional shapes of the fillets as seen along the blade surface 57 of the airfoil portion 41.

The first fillet portion 81 is provided closer to the trailing edge portion 75 of the platform 42 than a position X, at which a distance and a width between the suction side blade surface 53 of the airfoil portion 41 and the suction side end portion 44 of the platform 42 are smallest, while being on the suction side blade surface 53 side of the airfoil portion 41. The first fillet portion 81 is provided closer to the trailing edge portion 75 than a throat portion 110, which is formed between the airfoil portions 41 of the rotor blades 28 that are adjacent to each other in the circumferential direction Dc and which will be described later. A fillet width W1 of the first fillet portion 81 is set to be larger than a fillet width W of other regions of the fillet portion 80 excluding the first fillet portion 81. Here, the throat portion refers to a position where a minimum flow path width in a flow direction of the combustion gas FG between the rotor blades 28 that are adjacent to each other in the circumferential direction Dc is determined. Note that a tip of the fillet portion 80 in a direction along the fillet width W of the fillet portion 80, which is formed on the upper surface 71 of the platform 42, forms a lower outer edge 80*b*, and a tip of the fillet portion 80 which is formed in the blade height direction Dh along the blade surface 57 forms an upper outer edge 80*a*. Here, the fillet width W is a length or distance between the connecting portion 76, at which the airfoil portion 41 and the upper surface 71 of the platform 42 are bonded to each other, and the lower outer edge 80*b* of the fillet portion 80. A fillet height H is a length or height between the connecting portion 76, at which the airfoil portion 41 and the upper surface 71 of the platform 42 are bonded to each other, and the upper outer edge 80*a* of the fillet portion 80.

Here, a positional relationship between the throat portion 110 and the first fillet portion 81 will be described with reference to FIG. 3. In FIG. 3, the throat portion 110 refers to a position on the suction side blade surface 53 at which a perpendicular throat line SL, which extends from the position of the trailing edge 52 of the airfoil portion 41 of the adjacent rotor blade 28 to be perpendicular to the suction side blade surface 53 of the rotor blade 28, intersects with the suction side blade surface 53. Meanwhile, a first end portion 81*a* that forms the first fillet portion 81 and that is closest to the leading edge 51 side is formed closer to the trailing edge 52 than the position of the throat portion 110.

The second fillet portion 82 is provided closer to the trailing edge 52 than the first fillet portion 81. The second fillet portion 82 is formed on the trailing edge end surface 52*a* of the airfoil portion 41, is formed on the blade base end portion 55 side to be adjacent to the plurality of cooling holes 68 (refer to FIG. 2) which are arranged in the blade height direction Dh as seen in the blade height direction Dh, and is provided at the connecting portion 76 between the airfoil portion 41 and the platform 42. The fillet height H of the second fillet portion 82 is set to be smaller than the fillet height H of the fillet portion 80 in other regions excluding the second fillet portion 82.

The third fillet portion 83 is provided to extend from the leading edge 51 to the first fillet portion 81 on the suction side blade surface 53 side and is provided to extend from the leading edge 51 to a third fillet change portion 86, which will be described later, along the pressure side blade surface 54 with the leading edge 51 of the airfoil portion 41 being interposed.

As shown in FIGS. 3 and 4, the first fillet portion 81 is provided in a region A1 along the blade surface 57 which is on the suction side blade surface 53 side of the airfoil portion 41. The first fillet portion 81 is formed to have the fillet width W1 and a fillet height H1. Here, the cross-section of the fillet portion 80 is formed in a perfect circle shape or an oval shape and is externally tangent to the blade surface 57 and the upper surface 71 of the platform 42. A position on the blade surface 57 at which the cross-section is externally tangent to the blade surface 57 corresponds to the upper outer edge 80*a*, and a position on the upper surface 71 of the platform 42 at which the cross-section is externally tangent to the upper surface 71 corresponds to the lower outer edge 80*b*. The fillet portion 80 is formed by a curved portion (curved recessed surface) that smoothly connects the blade surface 57 of the airfoil portion 41 and the upper surface 71 of the platform 42. The fillet width W1 of the first fillet portion 81 is the length of the fillet portion 80 in a direction along the upper surface 71 of the platform 42, which is orthogonal to the blade surface 57 of the airfoil portion 41. The fillet height H1 is the length of the fillet portion 80 in the blade height direction Dh along the blade surface 57, which is orthogonal to the upper surface 71 of the platform 42. The first fillet portion 81 is formed at the connecting portion 76 at which the blade surface 57 of the airfoil portion 41 and the upper surface 71 of the platform 42 are connected to each other, the cross-sectional shape of the first fillet portion 81 is the shape of an arc of a perfect circle R1, and the first fillet portion 81 is continuously formed in a direction from the leading edge 51 side to the trailing edge 52 along the suction side blade surface 53. Therefore, the fillet width W1 of the first fillet portion 81 is approximately ½ (radius) of WR1, which is the length (diameter) of the perfect circle R1 in the direction along the fillet width W, and the fillet height H1 is approximately ½ (radius) of HR1, which is the length (diameter) of the perfect circle R1 in a fillet height direction.

As shown in FIGS. 3 and 5, the second fillet portion 82 is formed on the trailing edge end surface 52*a* of the airfoil portion 41 and is formed at a constant width in the circumferential direction within a region A2 that extends along the trailing edge end surface 52*a* of the blade surface 57. The second fillet portion 82 has a fillet width W2 and a fillet height H2. The second fillet portion 82 is formed at the connecting portion 76 at which the blade surface 57 of the airfoil portion 41 and the upper surface 71 of the platform 42 are connected to each other, the shape of the second fillet portion 82 is the oval shape of an oval R2, of which the major axis extends in the blade height direction Dh and the minor axis extends in a direction along the upper surface 71 of the platform 42, and the second fillet portion 82 is continuously formed along the trailing edge end surface 52*a*. Therefore, the fillet width W2 is approximately ½ of a length (minor axis) WR2 of the oval R2 in a fillet width direction, and the fillet height H2 is approximately ½ of a length (major axis) HR2 of the oval R2 in the fillet height direction. Note that a tip of the second fillet portion 82 in a direction along the fillet width W of the second fillet portion 82, which is formed on the upper surface of the platform 42, forms the lower outer edge 80*b* and corresponds to the position of the fillet width W2 from the blade surface 57 in FIG. 5. In addition, a tip of the second fillet portion 82 formed in the blade height direction Dh along the blade surface 57 forms the upper outer edge 80*a* and corresponds to the position of the fillet height H2 from the upper surface 71 of the platform 42 in FIG. 5. In addition, the fillet height H2 of the second fillet portion 82 is lower than the fillet height H of the fillet portion 80 in the other regions, and the fillet height H at the second fillet portion 82 is lowest.

As shown in FIGS. 3 and 6, the third fillet portion 83 is provided in a region A3 that extends along the blade surface 57 on the suction side blade surface 53 side and the pressure side blade surface 54 side of the airfoil portion 41. The third fillet portion 83 has a fillet width W3 and a fillet height H3. The third fillet portion 83 is formed at the connecting portion 76 at which the blade surface 57 of the airfoil portion 41 and the upper surface 71 of the platform 42 are connected to each other. The shape of the third fillet portion 83 is continuously formed in the oval shape of an oval R3, of which the major axis extends in the blade height direction Dh and the minor axis extends in a direction along the upper surface 71 of the platform 42. Therefore, the fillet width W3 is approximately ½ of a length (minor axis) WR3 of the oval R3 in the fillet width direction, and the fillet height H3 is approximately ½ of a length (major axis) HR3 of the oval R3 in the fillet height direction. Note that a tip of the third fillet portion 83 in a direction along the fillet width W of the third fillet portion 83, which is formed on the upper surface 71 of the platform 42, forms the lower outer edge 80*b* and corresponds to the position of the fillet width W3 from the blade surface 57 in FIG. 6. In addition, the position of a tip of the third fillet portion 83 formed in the blade height direction Dh along the blade surface 57 forms the upper outer edge 80*a* and corresponds to the position of the fillet height H3 from the upper surface 71 of the platform 42 in FIG. 6. Note that since the first fillet portion 81, the second fillet portion 82, and the third fillet portion 83 are different from each other in fillet width W and fillet height H, fillet change portions 87 (first fillet change portion 84, second fillet change portion 85, and third fillet change portion 86) smoothly connecting the fillet portions to each other are disposed between the first fillet portion 81 and the second fillet portion 82, between the second fillet portion 82 and the third fillet portion 83, and between the third fillet portion 83 and the first fillet portion 81. Since the fillet change portions 87 are disposed, the first fillet portion 81, the second fillet portion 82, and the third fillet portion 83 are smoothly connected to each other without a sudden change in shape of the fillet portion 80, and thus a decrease in aerodynamic performance of the fillet portion 80 can be suppressed.

As shown in FIGS. 4 to 6, regarding the first fillet portion 81, the aspect ratio of the fillet height H1 to the fillet width W1 (fillet height H1/fillet width W1) is set to be smaller than the aspect ratio of the fillet portion 80 in the other regions excluding the first fillet portion 81. That is, the first fillet portion 81 has an aspect ratio of 1.0 because the fillet width W1 and the fillet height H1 are equal to each other. The aspect ratio of the first fillet portion 81 is not limited to 1.0 as long as the aspect ratio thereof is smaller than the aspect ratio of the fillet portion 80 in the other regions excluding the first fillet portion 81. Meanwhile, the aspect ratio of the second fillet portion 82 is larger than 1.0 because the fillet height H2 is larger than the fillet width W2. In addition, the aspect ratio of the third fillet portion 83 is larger than 1.0 because the fillet height H3 is larger than the fillet width W3. Therefore, the aspect ratio of the first fillet portion 81 is smaller than the aspect ratio of the second fillet portion 82 and the aspect ratio of the third fillet portion 83.

In addition, as shown in FIGS. 2 and 3, the first fillet portion 81 includes the region A1 at which the aspect ratio is maintained constant along the blade surface 57 of the fillet portion 80. The second fillet portion 82 includes the region A2 at which the aspect ratio is maintained constant along the blade surface 57 of the trailing edge end surface 52*a* of the airfoil portion 41. The third fillet portion 83 includes the region A3 at which the aspect ratio is maintained constant along the blade surface 57 of the fillet portion 80.

As shown in FIGS. 3 to 6, the first fillet portion 81 includes the first end portion 81*a* that is provided on the leading edge 51 side while being on the suction side blade surface 53 side of the airfoil portion 41 along the blade surface 57 of the fillet portion 80 and a second end portion 81*b* that is provided on the trailing edge 52 side while being on the suction side blade surface 53 side of the airfoil portion 41 along the blade surface 57 of the fillet portion 80. The first end portion 81*a* and the second end portion 81*b* are connected to the fillet change portions 87 at which the fillet width W and the fillet height H change along the blade surface 57 of the fillet portion 80. In addition, the third fillet portion 83 includes a third end portion 83*a* that is provided on the first fillet portion 81 side while being formed on the suction side blade surface 53 side of the airfoil portion 41 along the blade surface 57 of the fillet portion 80 and a fourth end portion 83*b* that is formed on the trailing edge 52 side while being on the pressure side blade surface 54 side of the airfoil portion 41 along the blade surface 57 of the fillet portion 80. The third end portion 83*a* and the fourth end portion 83*b* are connected to the fillet change portions 87 at which the fillet width W and the fillet height H change along the blade surface 57 of the fillet portion 80.

The fillet change portions 87 include the first fillet change portion 84, the second fillet change portion 85, and the third fillet change portion 86. The first fillet change portion 84 is formed between the first end portion 81*a* and the third end portion 83*a* disposed closer to the leading edge 51 than the first end portion 81*a* and is provided in a region A11 along the suction side blade surface 53. At the first fillet change portion 84, the fillet width W becomes smaller toward the third end portion 83*a* from the first end portion 81*a*, and the fillet height H is maintained constant. That is, in a region extending from the first fillet portion 81 to the third end portion 83*a* of the third fillet portion 83 with the first fillet change portion 84 interposed therebetween, the fillet width W becomes smaller, but the fillet height H is maintained constant.

The second fillet change portion 85 is formed between the second end portion 81*b* and the second fillet portion 82 and is provided in a region A12 along the suction side blade surface 53. At the second fillet change portion 85, the fillet width W and the fillet height H become smaller toward the second fillet portion 82 from the second end portion 81*b*. The third fillet change portion 86 is formed between the fourth end portion 83*b* and the second fillet portion 82 and is provided in a region A13 along the pressure side blade surface 54. At the third fillet change portion 86, the fillet height H becomes smaller toward the second fillet portion 82 from the fourth end portion 83*b*, and the fillet width W is maintained constant.

In addition, as shown in FIG. 3, the first fillet portion 81 is provided along a final passage 70 on a most downstream side in the cooling air flow direction in the second cooling air passage 62, that is, a blade wall 58 of the third passage 67. Furthermore, the first fillet portion 81 is provided along the final passage 70 on the most downstream side in the cooling air flow direction in the second cooling air passage 62, that is, the passage cross-section of the third passage 67 that extends in a chord direction. The length of the region A1 of the first fillet portion 81 falls within the range of the length of the passage cross-section of the third passage 67 in the chord direction.

Here, the reason why the shape of the fillet portion 80 depends on the position of the fillet portion 80 along the blade surface 57 of the airfoil portion 41 described above will be described below.

First, a cooling structure on the trailing edge 52 side of the airfoil portion 41, which influences the shape of the fillet portion 80, will be described. As described above, the second cooling air passage 62 formed in the airfoil portion 41 forms a meandering passage composed of the first passage 63, the first turn-back passage 64, the second passage 65, the second turn-back passage 66, and the third passage 67. Therefore, the cooling air flowing through the second cooling air passage 62 is overheated when flowing in the cooling air passage 60, and the temperature of the cooling air flowing through the final passage 70 becomes high. Accordingly, the metal temperature of the blade wall 58 on the trailing edge 52 side, which forms the final passage 70, tends to become high. Meanwhile, a stress caused by a centrifugal force or the like is generated at the fillet portion 80 at which the airfoil portion 41 and the platform 42 are connected to each other. Therefore, a high thermal stress tends to be generated at the fillet portion 80 on the trailing edge 52 side, and some cooling means or thermal stress suppressing means needs to be provided in some cases.

The first fillet portion 81 is formed on the suction side blade surface 53 side of the airfoil portion 41. In a suction side region of the trailing edge portion 75 of the platform 42, which is surrounded by the suction side blade surface 53 of the airfoil portion 41, the suction side end portion 44 of the platform 42, and the trailing edge portion end surface 75*a* and is on the downstream side in the axial direction, the first cooling passage 72 described above is arranged merely from the leading edge 51 to the trailing edge 52 along the suction side end portion 44. Therefore, the suction side region of the trailing edge portion 75 of the platform 42 which is on the downstream side in the axial direction is in a state of not being cooled except for a region in which the first cooling passage 72 is disposed.

As described above, regarding the final passage 70 (third passage 67) of the second cooling air passage 62 of the airfoil portion 41, generation of a thermal stress generated on the blade base end portion 55 side of the airfoil portion 41 due to interaction between overheating caused by cooling air and a centrifugal force or the like and generation of a thermal stress caused by a thermal elongation difference due to the presence of a non-cooling region of the platform 42 overlap with each other, and thus a higher thermal stress than the other regions of the fillet portion 80 tends to be generated at the first fillet portion 81, which is in the vicinity of a region that is on the suction side blade surface 53 side of the airfoil portion 41 and is on the downstream side in the axial direction, along the upper surface 71 of the platform 42.

As shown in FIGS. 3 and 4, in order to suppress a thermal stress generated at the first fillet portion 81 in a horizontal direction along the upper surface 71 of the platform 42 to be equal to or lower than an allowable value, it is necessary to increase the fillet width W1 in a direction along the upper surface 71 of the platform 42 of a curved surface forming the first fillet portion 81 so that the stress is decreased. Therefore, for the first fillet portion 81, a width larger than the fillet width W of the fillet portion 80 in the other regions is selected. The first fillet portion 81 shown in FIG. 4 is formed of a circular recessed curved surface, has a recessed curved surface shape of which the aspect ratio, which is the ratio between the fillet height H1 and the fillet width W1, is 1.0, and is smaller than any other fillet portion 80 in aspect ratio.

As shown in FIGS. 2, 3, and 9, the second fillet portion 82 is formed on the trailing edge end surface 52*a* of the airfoil portion 41. As described above, the plurality of cooling holes 68 arranged in the blade height direction are disposed in the blade trailing edge portion 52*b* and are open at the trailing edge end surface 52*a*, so that the blade trailing edge portion 52*b* of the airfoil portion 41 is cooled. Meanwhile, forming the cooling holes 68 penetrating the second fillet portion 82 to cool the second fillet portion 82 formed on the trailing edge end surface 52*a* is not desirable in the viewpoint of concentrating a stress generated around the cooling holes 68. Therefore, it is desirable that, particularly, openings 68*a* in the trailing edge end surface 52*a*, at which the cooling holes 68 are open, in the blade height direction Dh are disposed as close as possible to the upper outer edge 80*a* of the fillet portion 80 in a processable range so that the fillet portion 80 including the second fillet portion 82, which is the fillet portion 80 of the blade trailing edge portion 52*b*, is cooled. Therefore, the fillet height H2 of the second fillet portion 82 formed on the trailing edge end surface 52*a* is made lower than the fillet portion 80 in any other region, and the positions of the openings 68*a* of the cooling holes 68 in the blade height direction Dh are brought close to the upper outer edge 80*a* of the second fillet portion 82 and close to the upper surface 71 of the platform 42 at a region on the downstream side in the axial direction.

The third fillet portion 83 is formed on the suction side blade surface 53 side and on the pressure side blade surface 54 with the leading edge 51 of the airfoil portion 41 interposed therebetween. As shown in FIG. 6, the aspect ratio of the sectional shape of the third fillet portion 83, which is the ratio between the fillet height H3 and the fillet width W3, exceeds 1.0 with the fillet height H3 being larger than the fillet width W3, and the third fillet portion 83 is formed as a fillet having an oval shape long in the blade height direction Dh. A thermal stress as high as a thermal stress at a region on the platform 42 that is on the downstream side in the axial direction and at which the first fillet portion 81 is formed is not generated in the connecting portion 76 between the platform 42 and the airfoil portion 41 at which the third fillet portion 83 is formed. Therefore, in consideration of the fact that it is advantageous that the aspect ratio is large from the viewpoint of aerodynamic performance, a fillet shape of which the aspect ratio exceeds 1 with the fillet width W being made smaller than the first fillet portion 81 without a change in fillet height H is selected for the third fillet portion 83.

Note that at all of the region A1 of the first fillet portion 81, the region A2 of the second fillet portion 82, and the region A3 of the third fillet portion 83, there is no change in fillet height H and fillet width W and the fillet height H and the fillet width W are maintained constant. However, the fillet change portions 87 that connect each fillet portion 80 and are disposed at intermediate positions are formed to smoothly connect each fillet portion 80 with the fillet height H or the fillet width W being gradually changed. A sudden change in fillet shape at each connection point (first end portion 81*a*, second end portion 81*b*, third end portion 83*a*, and fourth end portion 83*b*) is not desirable from the viewpoint of aerodynamic performance and stress concentration.

Figure 7:
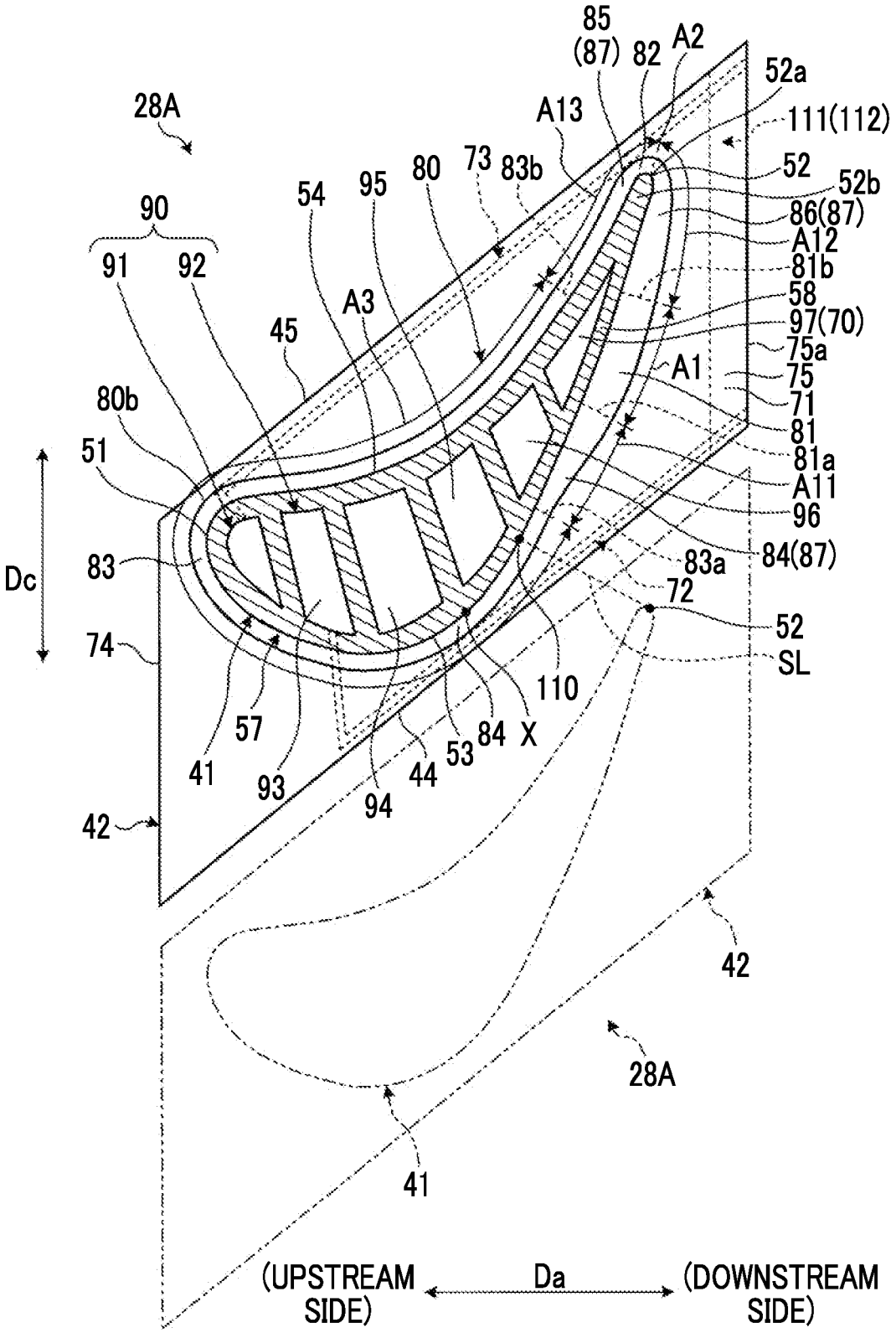
FIG. 7 is a cross-sectional view showing a modification example of a rotor blade as a turbine blade.

Note that the turbine blade of the present invention is not limited to the rotor blade 28 configured as described above. FIG. 7 is a cross-sectional view showing a modification example of a rotor blade as a turbine blade.

As shown in FIG. 7, a rotor blade 28A of the modification example is different from the first embodiment of the rotor blade 28, which is described above and is shown in FIGS. 2 to 6, in the configuration of the cooling air passage of the airfoil portion 41, and the other configurations thereof are the same as those of the first embodiment. The rotor blade 28A includes the airfoil portion 41, the platform 42, and the blade root portion 43 (refer to FIG. 2).

In the airfoil portion 41, a cooling air passage 90 is provided. The cooling air passage 90 includes a first cooling air passage 91 and a second cooling air passage 92. The first cooling air passage 91 is provided along the blade height direction Dh on the leading edge 51 side of the airfoil portion 41 and is open at the top plate 59 on the blade tip portion 56 side. In the first cooling air passage 91, cooling air supplied to the blade root portion 43 side flows along the leading edge 51 in one direction, and the cooling air is discharged into the combustion gas FG on the outside via an opening formed in the top plate 59 on the blade tip portion 56 side. Similarly to the rotor blade 28 described in the first embodiment, the second cooling air passage 92 is formed as a meandering passage (serpentine passage) inside the airfoil portion 41 and is provided on the trailing edge 52 side while being adjacent to the first cooling air passage 91. The second cooling air passage 92 includes a first passage 93, a first turn-back passage (not shown), a second passage 94, a second turn-back passage (not shown), a third passage 95, a third turn-back passage (not shown), a fourth passage 96, a fourth turn-back passage (not shown), and a fifth passage 97. The first passage 93, the second passage 94, the third passage 95, the fourth passage 96, and the fifth passage 97 are provided along the blade height direction Dh, and a portion of the fifth passage 97 that is on the blade tip portion 56 side is connected to the opening formed in the top plate 59. In the second cooling air passage 92, cooling air supplied to the blade root portion 43 side flows through the first passage 93, the first turn-back passage, the second passage 94, the second turn-back passage, the third passage 95, the third turn-back passage, the fourth passage 96, the fourth turn-back passage, and the fifth passage 97 in this order, and the cooling air is discharged to the outside via an opening formed in the top plate 59 of the blade tip portion 56. The fifth passage 97 also functions as the final passage 70 of the second cooling air passage 92.

In addition, regarding the rotor blade 28A, the fillet portion 80 is provided around the entire periphery of the blade surface 57 of the airfoil portion 41 so that stress concentration on the connecting portion 76 between the airfoil portion 41 and the platform 42 is prevented. Similarly to the rotor blade 28 described in the first embodiment, the fillet portion 80 includes the first fillet portion 81, the second fillet portion 82, and the third fillet portion 83. In addition, as fillet change portions, the first fillet change portion 84, the second fillet change portion 85, and the third fillet change portion 86 are provided. Since the configurations of the fillet portion 80 and the fillet change portions 87 are the same as the configurations in the first embodiment described above, the description thereof will be omitted.

As described above, the turbine blade of the first embodiment includes the airfoil portion 41 that internally includes the cooling air passage 60, the platform (blade base end portion) 42 that is provided at the blade base end portion 55 of the airfoil portion 41 in the blade height direction Dh, and the fillet portion 80 that is provided around the entire periphery of the blade surface 57 at the connecting portion 76 between the airfoil portion 41 and the platform 42. The fillet portion 80 includes the first fillet portion 81 that is provided closer to the trailing edge 52 than the position X, at which a distance and an interval between the suction side blade surface 53 of the airfoil portion 41 and the suction side end portion 44 of the platform 42 are smallest, while being on the suction side blade surface 53 side of the airfoil portion 41 and of which the fillet width W is larger than the fillet width W of other regions of the fillet portion 80.

Therefore, at a region on the fillet portion 80 that is on the downstream side in the axial direction Da while being on the trailing edge 52 side and on the suction side blade surface 53 side of the platform 42, a thermal stress higher than other regions is likely to be generated. Since the first fillet portion 81 which is larger than the fillet portion 80 in fillet width W is provided at the region, a thermal stress at the fillet portion 80 can be reduced. In addition, the first fillet portion 81 which is on the trailing edge 52 side while being on the suction side blade surface 53 side of the platform 42 is disposed downstream of the throat portion 110 in the axial direction Da in comparison with the third fillet portion 83 on the leading edge 51 side, and thus the influence of the fillet shape on the aerodynamic performance is small. Therefore, for the first fillet portion 81, a fillet larger than the third fillet portion 83 in fillet width W can be selected.

As described above, in the case of the turbine blade of the first embodiment, the first fillet portion 81 is provided to be closer to the trailing edge 52 than the throat portion 110 which is formed between the airfoil portions 41 that are adjacent to each other. As a result, it is possible to suppress a decrease in aerodynamic performance even if the fillet width W is large, while reducing a thermal stress at the fillet portion 80.

In the case of the turbine blade of the first embodiment, the aspect ratio of the fillet height H to the fillet width W of the first fillet portion 81 is smaller than the aspect ratios of the other fillet portions. Therefore, the fillet width W of the first fillet portion 81 is larger than those of the other fillet portions, and thus it is possible to reduce generation of a thermal stress caused due to a thermal elongation difference at the fillet portion 80.

In the case of the turbine blade of the first embodiment, the first fillet portion 81 is a region at which the aspect ratio is maintained constant along the blade surface 57 of the fillet portion 80. Therefore, it is possible to reduce a thermal stress in a predetermined region (region A1) along the blade surface 57 of the fillet portion 80.

In the case of the turbine blade of the first embodiment, the aspect ratio of the first fillet portion 81 is 1.0. Therefore, a thermal stress at the first fillet portion 81 can be reduced.

In the case of the turbine blade of the first embodiment, the first fillet portion 81 includes the first end portion 81*a* that is provided on the leading edge 51 side of the airfoil portion 41 along the blade surface 57 of the fillet portion 80 and the second end portion 81*b* that is provided on the trailing edge 52 side of the airfoil portion 41 along the blade surface 57 of the fillet portion 80. The first end portion 81*a* and the second end portion 81*b* of the first fillet portion 81 are connected to the fillet change portions 84 and 85 at which the fillet width W or the fillet height H changes along the blade surface 57 of the fillet portion 80 in the other regions. Therefore, since the first fillet portion 81 and the other fillet portions 80 (second fillet portion 82 and third fillet portion 83) are connected to each other via the fillet change portions 84 and 85 at which the fillet width W or the fillet height H changes, the fillet portion 80 that is smoothly connected to a connecting portion between the airfoil portion 41 and the platform 42 is provided, and thus it is possible to suppress a decrease in aerodynamic performance and to suppress stress concentration.

In the case of the turbine blade of the first embodiment, the plurality of cooling holes 68 arranged at predetermined intervals in the blade height direction Dh of the blade trailing edge portion 52*b* on the trailing edge 52 side are disposed in the airfoil portion 41. One end of each cooling hole 68 communicates with the cooling air passage 60, and the other end thereof is open at the trailing edge end surface 52*a* of the trailing edge 52. The fillet portion 80 includes the second fillet portion 82 of which the fillet height H is set to be smaller than the fillet height H of the other fillet portion 80. The second fillet portion 82 is provided on the trailing edge end surface 52*a* to be closer to the platform 42 and more adjacent to the platform 42 in the blade height direction Dh than the cooling holes 68. Therefore, since the fillet height H of the second fillet portion 82 is smaller than the fillet height H of the other fillet portion 80, the fillet portion 80 of the blade trailing edge portion 52*b* including the second fillet portion 82 and a region of the platform 42 that is on the downstream side in the axial direction while being on the trailing edge 52 side can be efficiently cooled by means of cooling air flowing through the cooling holes 68, and a thermal stress at the fillet portion 80 of the blade trailing edge portion 52*b* including the second fillet portion 82 can be reduced.

In the case of the turbine blade of the first embodiment, regarding the fillet portion 80, the suction side blade surface 53 side extends from the leading edge 51 of the airfoil portion 41 to the second fillet portion 82 via the third fillet portion 83, the first fillet change portion 84, the first fillet portion 81, and the second fillet change portion 85. The pressure side blade surface 54 side extends to the second fillet portion 82 via the third fillet portion 83 and the third fillet change portion 86. Therefore, the fillet portion 80 having an appropriate shape can be provided around the entire periphery of the connecting portion between the airfoil portion 41 and the platform 42.

In the case of the turbine blade of the first embodiment, the aspect ratio of the fillet height H to the fillet width W of the third fillet portion 83 is maintained constant along the blade surface 57 of the fillet portion 80. Therefore, it is possible to reduce a thermal stress in a predetermined region in the blade surface 57 of the fillet portion 80 while suppressing a decrease in aerodynamic performance.

In the case of the turbine blade of the first embodiment, the first fillet change portion 84 is provided between the first end portion 81*a* and the third end portion 83*a*. At the first fillet change portion 84, the fillet width W becomes smaller toward the third end portion 83*a* from the first end portion 81*a*, and the fillet height H is maintained constant. In this case, the shape of the first fillet change portion 84 is an oval shape of which the aspect ratio exceeds 1.0. Therefore, since the first fillet portion 81 and the third fillet portion 83 can be smoothly connected to each other by means of the first fillet change portion 84 and the fillet width W can be made smaller than that of the first fillet portion 81, it is possible to suppress a decrease in aerodynamic performance and to suppress stress concentration.

In the case of the turbine blade of the first embodiment, the second fillet change portion 85 is provided between the second end portion 81*b* and the second fillet portion 82. At the second fillet change portion 85, the fillet width W and the fillet height H become smaller toward the second fillet portion 82 from the second end portion 81*b*. Note that at the second fillet change portion 85, a rate at which the fillet width W is changed is larger than a rate at which the fillet height H is changed. In this case, the shape of the second fillet change portion 85 is an oval shape of which the aspect ratio exceeds 1.0. Therefore, since the first fillet portion 81 and the second fillet portion 82 can be smoothly connected to each other by means of the second fillet change portion 85 and the fillet width W can be made smaller than that of the first fillet portion 81, it is possible to suppress a decrease in aerodynamic performance and to suppress stress concentration.

In the case of the turbine blade of the first embodiment, the third fillet change portion 86 is provided between the fourth end portion 83*b* and the second fillet portion 82. At the third fillet change portion 86, the fillet height H becomes smaller toward the second fillet portion 82 from the fourth end portion 83*b*, and the fillet width W is maintained constant. In this case, the shape of the third fillet change portion 86 is an oval shape of which the aspect ratio exceeds 1.0. Therefore, the second fillet portion 82 and the third fillet portion 83 can be smoothly connected to each other by means of the third fillet change portion 86, and it is possible to suppress a decrease in aerodynamic performance and to suppress stress concentration by making the fillet height H small and making the positions of the cooling holes 68 close to the upper surface 71 of the platform 42.

In the case of the turbine blade of the first embodiment, the first fillet portion 81 is provided in the blade height direction Dh along the blade wall 58 of the third passage 67, which is the final passage 70 on a most downstream side in the cooling air flow direction in the cooling air passage 60. Therefore, the first fillet portion 81 can be effectively cooled by means of cooling air flowing through the third passage 67 in the cooling air passage 60.

In the case of the turbine blade of the first embodiment, the second cooling air passage 62 as a meandering passage is provided in the airfoil portion, the first fillet portion 81 is provided along the passage cross-section of the third passage 67 that extends in the chord direction, and the length of the region A1 of the first fillet portion 81 falls within the range of the length of the third passage 67 in the chord direction, the third passage 67 being the final passage 70 on the most downstream side in the cooling air flow direction in the second cooling air passage 62. Therefore, since the length of the third passage 67 in the chord direction is larger than the length of the region A1 of the first fillet portion 81, convection cooling is performed by means of cooling air flowing through the third passage 67, and the first fillet portion 81 can be appropriately cooled.

In the case of the turbine blade of the first embodiment, the first cooling passage 72 and the second cooling passage 73 extending from the leading edge portion 74 to the trailing edge portion 75 of the platform 42 are provided on the pressure side blade surface 54 side and the suction side blade surface 53 side of the airfoil portion 41, and portions of the first cooling passage 72 and the second cooling passage 73 on an upstream side in the cooling air flow direction communicate with the cooling air passage 60. Therefore, it is possible to efficiently cool the platform 42 by supplying a portion of cooling air supplied to the airfoil portion 41 to the first cooling passage 72 and the second cooling passage 73 disposed in the platform 42 and convection-cooling the platform 42.

In the case of the turbine blade of the first embodiment, the turbine blade is applied to the rotor blade 28. Therefore, it is possible to suppress a decrease in performance of the rotor blade 28 and to reduce a thermal stress at the fillet portion 80.

In addition, the gas turbine of the first embodiment includes the compressor 11, the combustor 12 that mixes compressed air compressed by the compressor 11 and fuel with each other and that performs combustion, and the turbine 13 that includes the rotor blades 28 as turbine blades and that obtains rotational power by means of the combustion gas FG generated by the combustor 12. Therefore, it is possible to suppress a decrease in performance of the turbine 13 and to reduce a thermal stress at the fillet portion 80.

Second Embodiment

Figure 10:
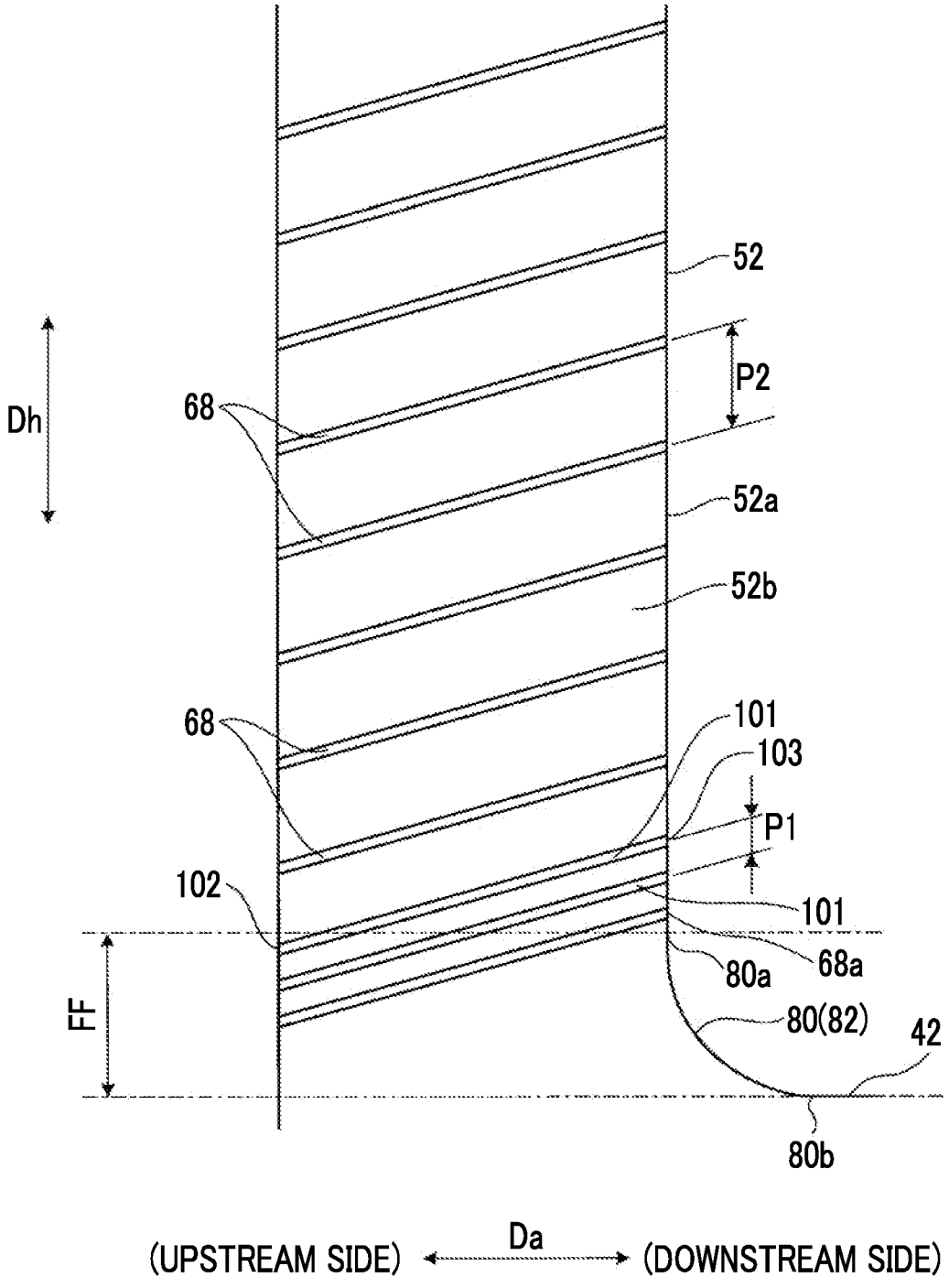
FIG. 10 is an enlarged view of a main part in FIG. 9.

FIG. 8 is a cross-sectional view showing a rotor blade as a turbine blade in a second embodiment, FIG. 9 is a cross-sectional view showing the vicinity of a blade base end portion of the turbine blade as seen along arrow IX-IX in FIG. 8, and FIG. 10 is an enlarged view of a main part in FIG. 9. Note that members having the same functions as those in the first embodiment will be given the same reference numerals, and detailed description thereof will be omitted.

In the second embodiment, similarly to the rotor blade 28 in the first embodiment described above, a rotor blade 28B includes the airfoil portion 41, the platform 42, and the blade root portion 43 (refer to FIG. 2) as shown in FIGS. 8 and 9.

In addition, regarding the rotor blade 28B, the fillet portion 80 is provided around the entire periphery of the blade surface 57 of the airfoil portion 41 so that stress concentration on the connecting portion 76 between the airfoil portion 41 and the platform 42 is prevented. Similarly to the rotor blade 28 described in the first embodiment, the fillet portion 80 includes the first fillet portion 81, the second fillet portion 82, and the third fillet portion 83. In addition, as fillet change portions, the first fillet change portion 84, the second fillet change portion 85, and the third fillet change portion 86 are provided. Since the configurations of the fillet portion 80 and the fillet change portions are the same as the configurations in the first embodiment described above, the description thereof will be omitted.

Regarding the airfoil portion 41, the plurality of cooling holes 68 are provided in the blade trailing edge portion 52*b* on the trailing edge 52 side. The plurality of cooling holes 68 are arranged at predetermined intervals in the blade height direction Dh, one end of each cooling hole 68 communicates with the third passage 67 in the second cooling air passage 62, and the other end of each cooling hole 68 is open at the trailing edge end surface 52*a* of the trailing edge 52. In addition, at positions on the trailing edge end surface 52*a* of the airfoil portion 41 that are close to the platform 42 side, the cooling holes 68 are disposed at positions on an outer side in the blade height direction Dh that are adjacent to the upper outer edge 80*a* of the second fillet portion 82. As will be described later, the plurality of cooling holes 68 include a plurality of end portion cooling holes 101 of which the opening density is higher than the opening density of the plurality of other cooling holes 68.

As shown in FIG. 10, the one end 102 of each of the plurality of end portion cooling holes 101, which is on the upstream side, communicates with the third passage 67 in the second cooling air passage 62 and the other end 103 thereof, which is on the downstream side, is open at the trailing edge end surface 52*a* of the trailing edge 52.

The opening density of the end portion cooling holes 101 in the blade height direction Dh is higher than that of the cooling holes 68 which are positioned closer to the blade tip portion 56 (refer to FIG. 2) than the end portion cooling holes 101, the end portion cooling holes 101 being positioned on the blade base end portion 55 (refer to FIG. 2) side on which the second fillet portion 82 is provided. Therefore, with the end portion cooling holes 101 disposed close to the upper outer edge 80*a* of the fillet portion 80, the amount of supply of cooling air can be sufficiently secured, and convection cooling of the second fillet portion 82 can be performed more effectively. Note that the opening density D of the cooling holes 68 is D=(S/P) where P is the arrangement pitch of the cooling holes 68 and S is the wetted perimeter length of the cooling holes 68. That is, the larger the arrangement pitch P of the cooling holes 68 is, the lower the opening density D is, and the larger the wetted perimeter length S is, the higher the opening density D is. In a case where the cooling holes 68 are circular, the wetted perimeter length S corresponds to a circumferential length.

As shown in FIGS. 8 and 9, the trailing edge portion 75 of the platform 42 is provided with the recessed groove portion 111. The recessed groove portion 111 is formed on the trailing edge portion end surface 75*a* of the platform 42 and is provided to be recessed toward the leading edge 51 side starting from the trailing edge portion end surface 75*a*. That is, the recessed groove portion 111 is open toward the trailing edge portion end surface 75*a* side of the platform 42 with the leading edge side end portion 112 being positioned at an end portion on the most upstream side in the axial direction Da, the leading edge side end portion 112 forming a portion of the recessed groove portion 111. The leading edge side end portion 112 of the recessed groove portion 111 is provided from the suction side end portion 44 side of the platform 42 to the pressure side end portion 45 side along the circumferential direction Dc. Therefore, an opening of the recessed groove portion 111 is formed from the suction side end portion 44 side to the pressure side end portion 45 at the trailing edge portion end surface 75*a* of the platform 42, is a portion of the suction side end portion 44 side and the pressure side end portion 45, and is formed over a range from the trailing edge portion end surface 75*a* to a connection position with respect to the leading edge side end portion 112 which is on the upstream side in the axial direction Da.

The recessed groove portion 111 extends to the suction side end portion 44 side from the pressure side end portion 45 side of the platform 42. The leading edge side end portion 112 of the recessed groove portion 111 is formed from the pressure side end portion 45 side to the suction side end portion 44 side of the platform 42 and is formed to be close to the trailing edge portion end surface 75*a* of the platform 42. That is, the leading edge side end portion 112 of the recessed groove portion 111, which is on the leading edge 51 side of the platform 42, is positioned between an end portion (one end 102) on the trailing edge 52 side of the final passage 70 (that is, third passage 67), which is on the most downstream side in the cooling air flow direction in the second cooling air passage 62 of the airfoil portion 41, and the trailing edge end surface 52*a* of the airfoil portion 41 as seen in a plan view (FIG. 8) of the platform 42. The leading edge side end portion 112 of the recessed groove portion 111 is linearly formed from the suction side end portion 44 to the pressure side end portion 45 of the platform 42 and is formed to be inclined with respect to the circumferential direction Dc and inclined with respect to the trailing edge portion end surface 75*a*. Since the leading edge side end portion 112 of the recessed groove portion 111 is linearly formed, processing is easy.

Providing the recessed groove portion 111 at the trailing edge portion 75 of the platform 42 results in a decrease in rigidity of the trailing edge portion 75 of the platform, which has significance for reducing rigidity. It is possible to reduce a thermal stress at the trailing edge portion 75 of the platform and the fillet portion 80 by reducing the rigidity of the trailing edge portion 75 of the platform.

In the vicinity of the position of the trailing edge portion 75 in a width direction (circumferential direction Dc) of the platform 42, the leading edge side end portion 112 of the recessed groove portion 111 is provided to be inclined with respect to the width direction (circumferential direction Dc) of the platform 42 such that the leading edge side end portion 112 becomes closer to the leading edge 51 side toward the pressure side end portion 45 side from the suction side end portion 44 side. Therefore, the recessed groove portion 111 can be formed to have a sufficient depth in a direction to the leading edge 51 side in the vicinity of the connecting portion 76 (second fillet portion 82) between the trailing edge end surface 52*a* of the airfoil portion 41 where stress reduction is highly necessary and the platform 42, and thus it is possible to reduce a thermal stress at the fillet portion 80 including the second fillet portion 82 and the trailing edge portion 75 of the platform 42.

Note that in the embodiments described above, the description has been made with the turbine blade of the present invention applied to the rotor blade 28. However, the turbine blade may also be applied to the stator vane 27.

REFERENCE SIGNS LIST

10: gas turbine
11: compressor
12: combustor
13: turbine
27: stator vane
28, 28A, 28B: rotor blade (turbine blade)
32: rotor
41: airfoil portion
42: platform (blade base end portion)
43: blade root portion
44: suction side end portion
45: pressure side end portion
51: leading edge
52: trailing edge
52*a*: trailing edge end surface
52*b*: blade trailing edge portion
53: suction side blade surface
54: pressure side blade surface
55: blade base end portion
56: blade tip portion
57: blade surface
58: blade wall
59: top plate
60, 90: cooling air passage
61, 91: first cooling air passage
61*a*: first supply passage
62,92: second cooling air passage
62*a*: second supply passage
68: cooling hole
68*a*: opening
70: final passage
71: upper surface
72: first cooling passage
73: second cooling passage
74: leading edge portion
75: trailing edge portion
75*a*: trailing edge portion end surface
76: connecting portion
80: fillet portion
80*a*: upper outer edge
80*b*: lower outer edge
81: first fillet portion
81*a*: first end portion
81*b*: second end portion
82: second fillet portion
83: third fillet portion
83*a*: third end portion
83*b*: fourth end portion
84: first fillet change portion
85: second fillet change portion
86: third fillet change portion
87: fillet change portion
101: end portion cooling hole
102: one end
103: other end
110: throat portion
111: recessed groove portion
112: leading edge side end portion
Da: axial direction
Dc: circumferential direction
Dh: blade height direction
SL: throat line

The invention claimed is:

1. A turbine blade comprising:

an airfoil portion that internally includes a cooling air passage;

a blade base end portion that is provided at an end portion of the airfoil portion in a blade height direction; and a fillet portion that is provided such that a fillet width and a fillet height are smoothly connected at all locations around an entire periphery of all connections between the airfoil portion and the blade base end portion, wherein the fillet portion includes a first fillet portion having a first fillet width that is larger than the fillet width of all other regions of the fillet portion, and the first fillet portion is provided closer to a trailing edge than a position at which a distance between a suction side blade surface of the airfoil portion and a suction side end portion of the blade base end portion is smallest and is provided on a leading edge side of the airfoil portion with respect to the trailing edge while being on a suction side of the airfoil portion.

2. The turbine blade according to claim 1, wherein the first fillet portion is provided closer to the trailing edge than a throat portion between an adjacent airfoil portion and the first fillet portion.

3. The turbine blade according to claim 1, wherein the first fillet portion is formed such that an aspect ratio of the first fillet portion is smaller than an aspect ratio of the other regions of the fillet portion.

4. The turbine blade according to claim 3, wherein the first fillet portion includes a region at which the aspect ratio of the first fillet portion is constant along a circumferential direction of the fillet portion.

5. The turbine blade according to claim 3, wherein the aspect ratio of the first fillet portion is 1.0.

6. The turbine blade according to claim 3, wherein the first fillet portion includes a first end portion that is provided on the leading edge side of the airfoil portion along a blade surface of the fillet portion and a second end portion that is provided on a trailing edge side of the airfoil portion along the blade surface of the fillet portion, and the first end portion and the second end portions of the first fillet portion are respectively connected to a first fillet change portion and a second fillet change portions, at which the fillet width or the fillet height changes along the blade surface of the fillet portion.

7. The turbine blade according to claim 6, wherein the airfoil portion includes a plurality of cooling holes that are arranged in a trailing edge portion at predetermined intervals in the blade height direction and each of which has one end communicating with the cooling air passage and has the other end open at a trailing edge end surface of the trailing edge portion and the fillet portion includes a second fillet portion that is provided on the trailing edge end surface while being adjacent to the cooling holes and adjacent to an inner side in the blade height direction and of which the fillet height is smaller than the fillet height of the other regions of the fillet portion.

8. The turbine blade according to claim 7, wherein the fillet portion includes a third fillet portion that is connected to the first fillet portion via the first fillet change portion along the suction side blade surface and is connected to the second fillet portion via a third fillet change portion along a pressure side blade surface, with a leading edge of the airfoil portion being interposed between the suction side blade surface and the pressure side blade surface.

9. The turbine blade according to claim 8, wherein the third fillet portion includes a region at which the aspect ratio is constant along the blade surface of the fillet portion.

10. The turbine blade according to claim 8, wherein the first fillet change portion is provided between the first end portion of the first fillet portion and a third end portion of the third fillet portion, and the fillet width of the first fillet change portion becomes smaller toward the third end portion from the first end portion while the fillet height of the first fillet change portion is maintained constant.

11. The turbine blade according to claim 10, wherein the first fillet change portion includes a fillet having an oval shape, of which the aspect ratio exceeds 1.0.

12. The turbine blade according to claim 7, wherein the second fillet change portion provided between the second end portion and the second fillet portion, and the fillet width and the fillet height of the second fillet change portion become smaller toward the second fillet portion from the second end portion.

13. The turbine blade according to claim 12, wherein the second fillet change portion includes a fillet having an oval shape, of which the aspect ratio exceeds 1.0.

14. The turbine blade according to claim 8, wherein the third fillet change portion is provided between the second fillet portion and a fourth end portion of the third fillet portion, and the fillet height of the third fillet change portion becomes smaller toward the second fillet portion from the fourth end portion while the fillet width of the third fillet change portion is maintained constant.

15. The turbine blade according to claim 14, wherein the third fillet change portion includes a fillet having an oval shape, of which the aspect ratio exceeds 1.0.

16. The turbine blade according to claim 15, wherein the plurality of cooling holes include end portion cooling holes, of which an opening density is higher than an opening density of a plurality of other cooling holes, at positions adjacent to the second fillet portion on the base end portion side of the airfoil portion, and the end portion cooling holes are disposed to be adjacent to the airfoil portion side of the second fillet portion in the blade height direction.

17. The turbine blade according to claim 1, wherein the first fillet portion is provided along a blade wall of a final passage on a most downstream side in a cooling air flow direction in the cooling air passage.

18. The turbine blade according to claim 17, wherein the cooling air passage includes a meandering passage provided in the airfoil portion, the first fillet portion is provided along the final passage on the most downstream side in the cooling air flow direction in the meandering passage, and a length of a region of the first fillet portion falls within a range of a length of the final passage in a chord direction.

19. The turbine blade according to claim 1, wherein the blade base end portion includes a platform that extends in a direction orthogonal to the blade height direction of the airfoil portion, the platform includes a recessed groove portion that is formed at a trailing edge portion end surface of the platform and is recessed toward the leading edge side from the trailing edge portion end surface, the recessed groove portion extends from a pressure side end portion to a suction side end portion of the platform, and an end portion of the recessed groove portion that is on the leading edge side is provided to become closer to the trailing edge portion end surface of the platform toward the suction side end portion from the pressure side end portion of the platform.

20. The turbine blade according to claim 19, wherein the end portion of the recessed groove portion that is on the leading edge side of the platform is positioned between a final passage on a most downstream side in a cooling air flow direction in the cooling air passage and a trailing edge portion of the airfoil portion as seen in a plan view of the platform.

21. The turbine blade according to claim 19, wherein the end portion of the recessed groove portion that is on the leading edge side of the platform is linearly formed toward the suction side end portion from the pressure side end portion of the platform.

22. The turbine blade according to claim 19, wherein the platform includes a first cooling passage that extends from the leading edge to the trailing edge along the suction side end portion of the platform and a second cooling passage that extends from the leading edge to the trailing edge along the pressure side end portion of the platform, and the first cooling passage and the second cooling passage communicate with the cooling air passage of the airfoil portion on an upstream side in a cooling air flow direction and are open to a combustion gas at the trailing edge portion end surface on a downstream side in the cooling air flow direction.

23. The turbine blade according to claim 1, wherein the turbine blade is a rotor blade.

24. A gas turbine comprising:

a compressor that compresses air;

a combustor that mixes compressed air compressed by the compressor and fuel with each other and that performs combustion; and a turbine that includes the turbine blade according to claim 1 and that obtains rotational power by means of a combustion gas generated by the combustor.

* * * * *